US006782954B2

(12) United States Patent
Serafin et al.

(10) Patent No.: US 6,782,954 B2
(45) Date of Patent: Aug. 31, 2004

(54) OPEN HOLE STRADDLE TOOL

(75) Inventors: Witold P. Serafin, Calgary (CA); Piro T. Shkurti, Calgary (CA); Barry J. Tate, Strathmore (CA)

(73) Assignee: Innicor Subsurface Technologies Inc., Calgary (CA)

( * ) Notice: Subject to any disclaimer, the term of this patent is extended or adjusted under 35 U.S.C. 154(b) by 84 days.

(21) Appl. No.: 10/303,982

(22) Filed: Nov. 26, 2002

(65) Prior Publication Data

US 2003/0111236 A1 Jun. 19, 2003

(51) Int. Cl.[7] ..... E21B 33/127
(52) U.S. Cl. ..... 166/387; 166/187; 166/191
(58) Field of Search ..... 166/387, 126, 166/129, 133, 187, 188, 191

(56) References Cited

U.S. PATENT DOCUMENTS 5,383,520 A 1/1995 Tucker et al.
5,782,306 A 7/1998 Serafin
6,253,856 B1 * 7/2001 Ingram et al. ..... 166/374
6,315,053 B1 11/2001 Coronado
6,394,184 B2 5/2002 Tolman et al.
2002/0153142 A1 * 10/2002 Eslinger et al. ..... 166/305.1
2003/0019628 A1 * 1/2003 Ravensbergen et al. .... 166/308

OTHER PUBLICATIONS www.packersplus.com/pplushome%20page.htm, 2 pages, Nov. 7, 2002.
www.packersplus.com/RockSeal%20Service%20Tools–Straddle%20S . . . , 2 pages, Nov. 7, 2002.
Packers Plus Completion Tip . . . 1 page, Jan. 1, 2001.

* cited by examiner

*Primary Examiner*—William Neuder
(74) *Attorney, Agent, or Firm*—Bennett Jones LLP

(57) ABSTRACT

A straddle packer tool comprises a mandrel and a housing. Spaced packers are carried by the housing. A plurality of bypass ports are arranged in the mandrel and housing for aligning in several positions: a first downhole position for bypassing fluid around the packers and through the mandrel; an intermediate position wherein the bypass ports are misaligned and a first internal pressure actuates the packers to isolate a zone and a second higher internal pressure releases a stop for enabling relative movement to an uphole position wherein the bypasses are misaligned and the mandrel's bore is opened to isolated zone.

27 Claims, 24 Drawing Sheets

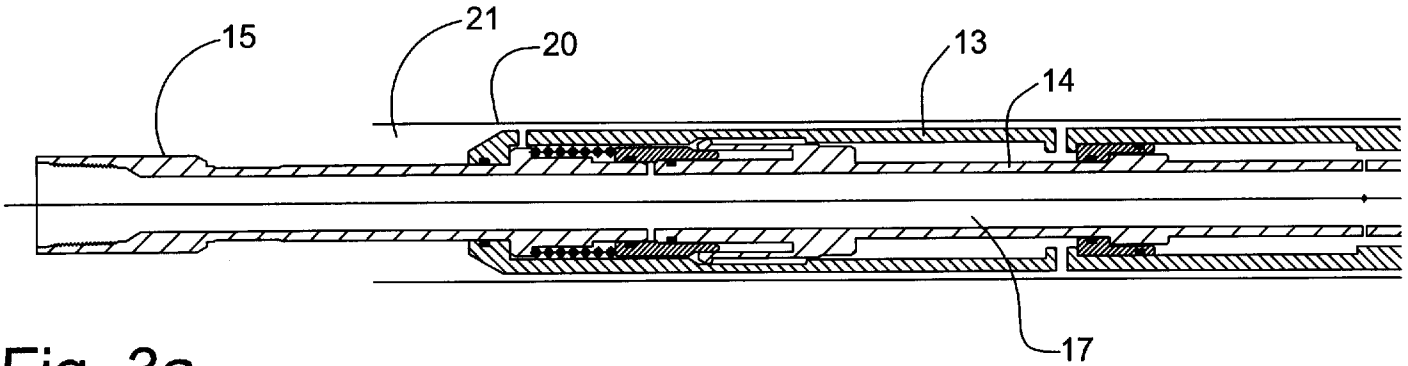
Fig. 3a RUN IN (VERTICAL)
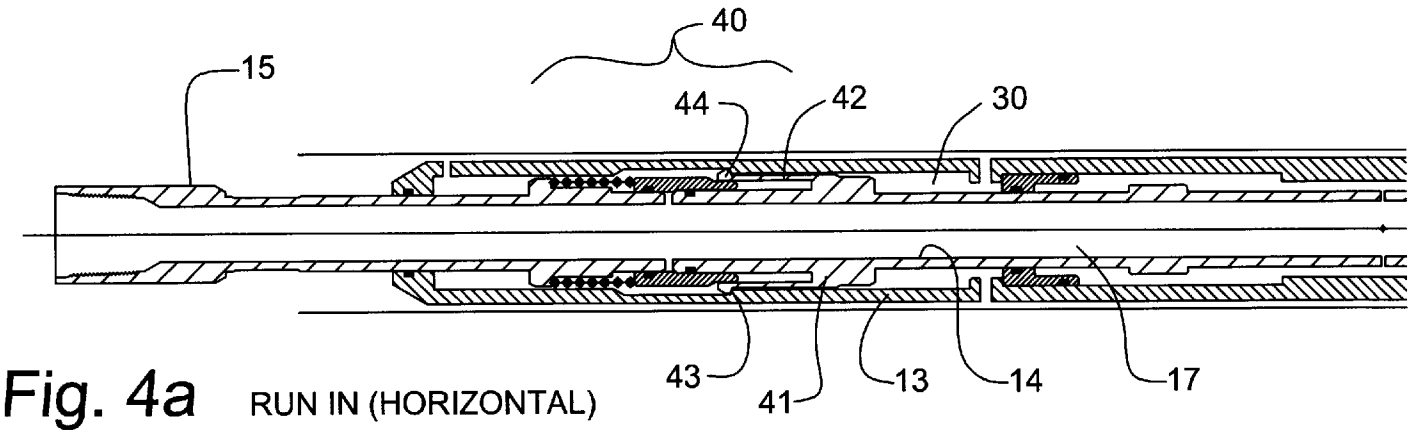
Fig. 4a RUN IN (HORIZONTAL)

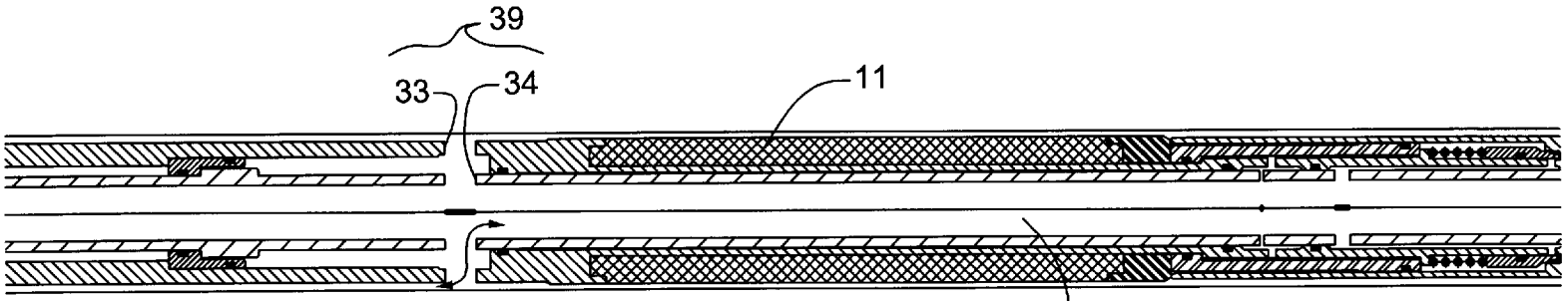
Fig. 3b RUN IN (VERTICAL)
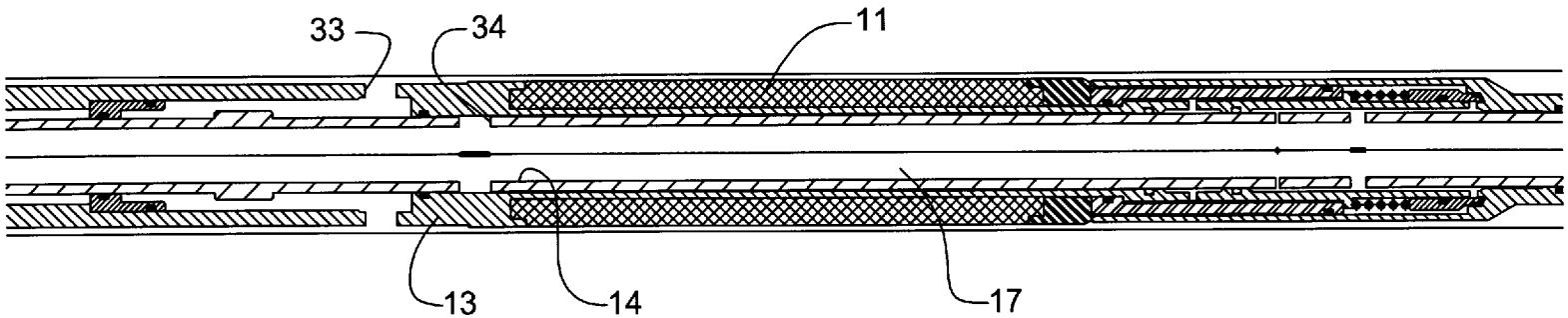
Fig. 4b RUN IN (HORIZONTAL)

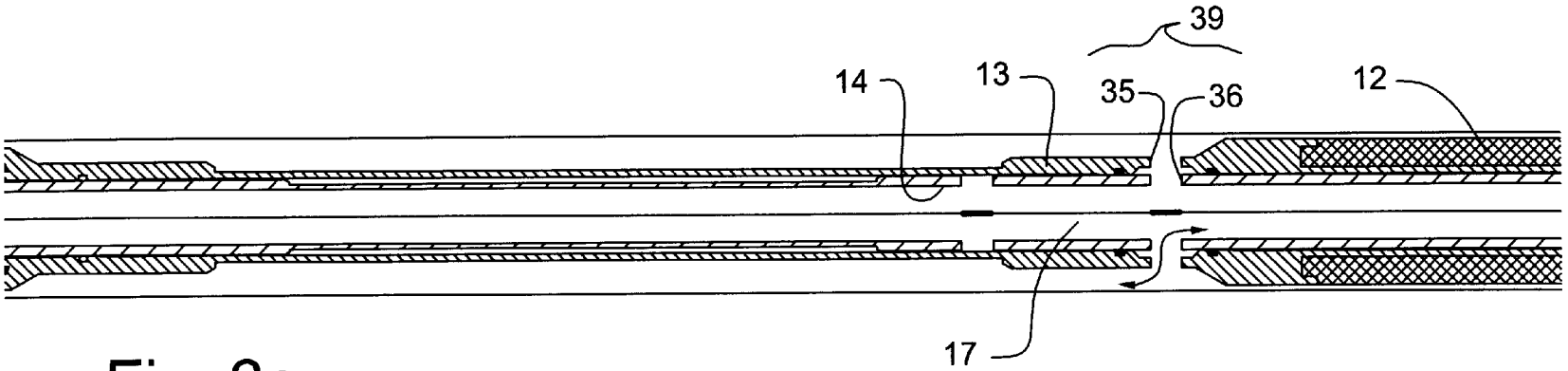
Fig. 3c RUN IN (VERTICAL)
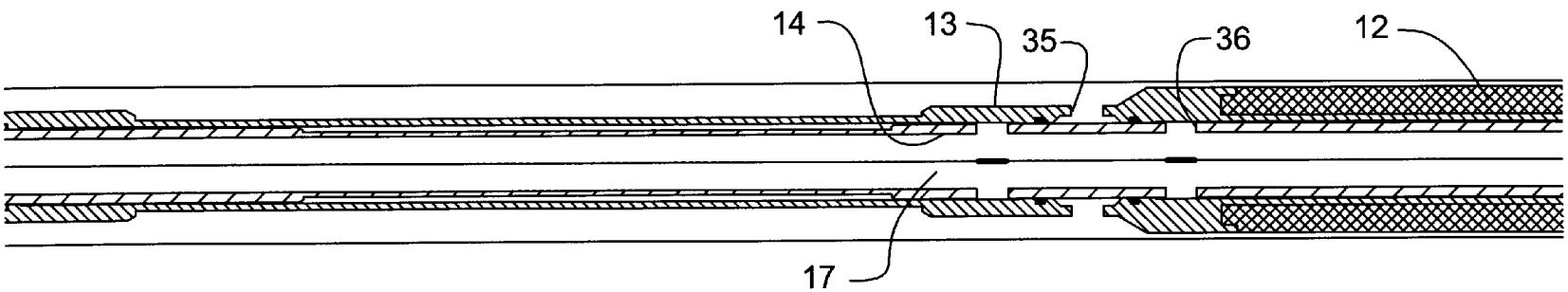
Fig. 4c RUN IN (HORIZONTAL)

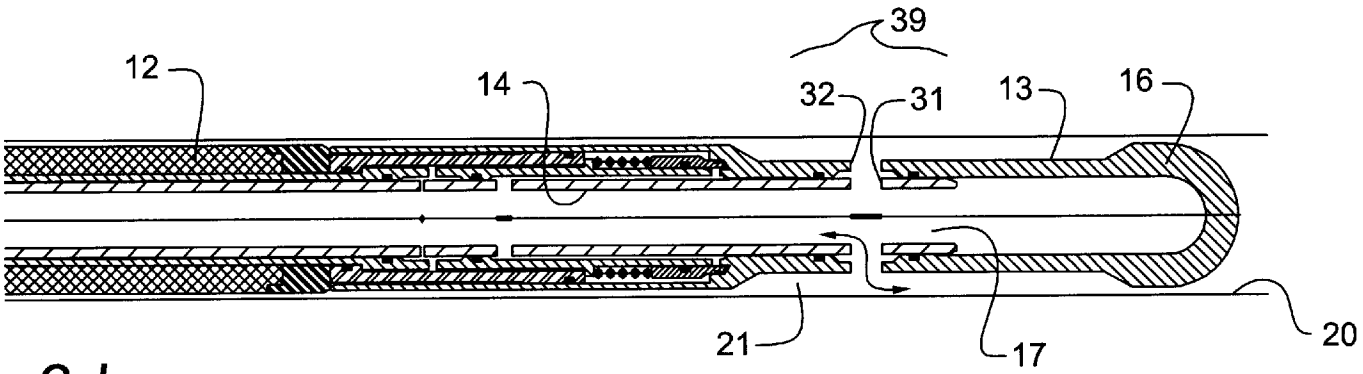
Fig. 3d RUN IN (VERTICAL)
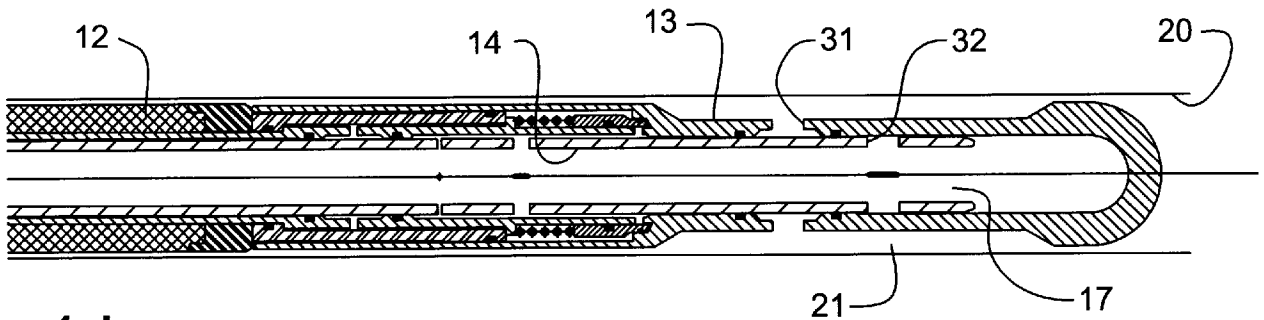
Fig. 4d RUN IN (HORIZONTAL)

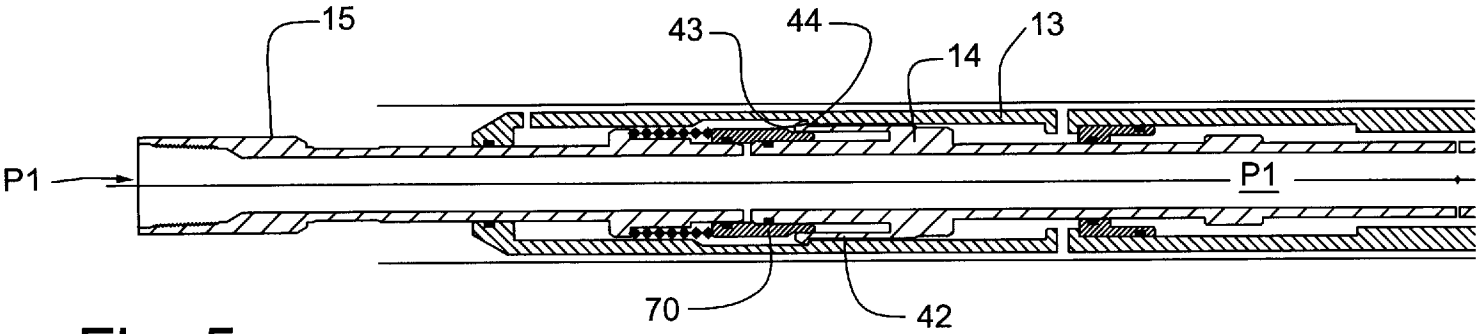
Fig. 5a SET
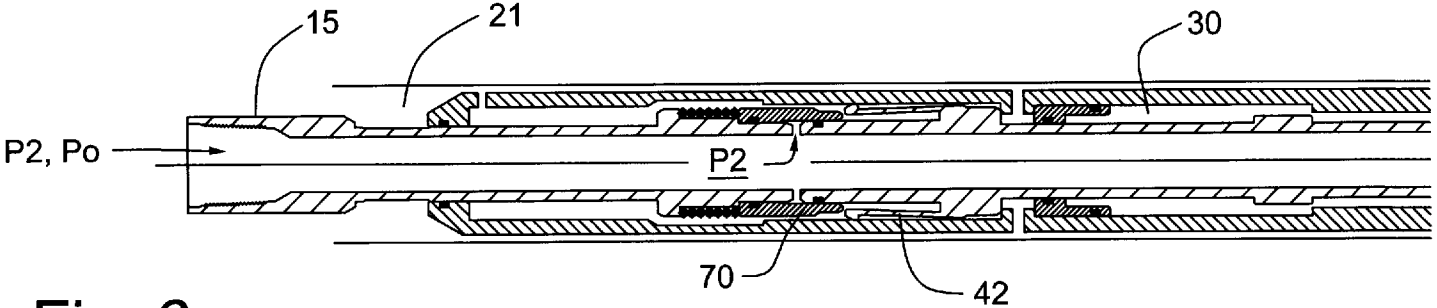
Fig. 6a OPERATIONS (e.g. ACIDIZE)

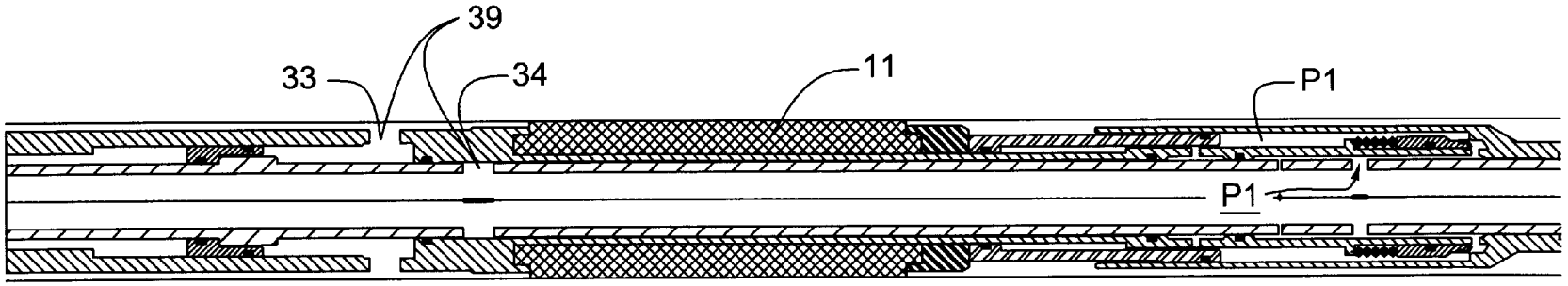
Fig. 5b SET
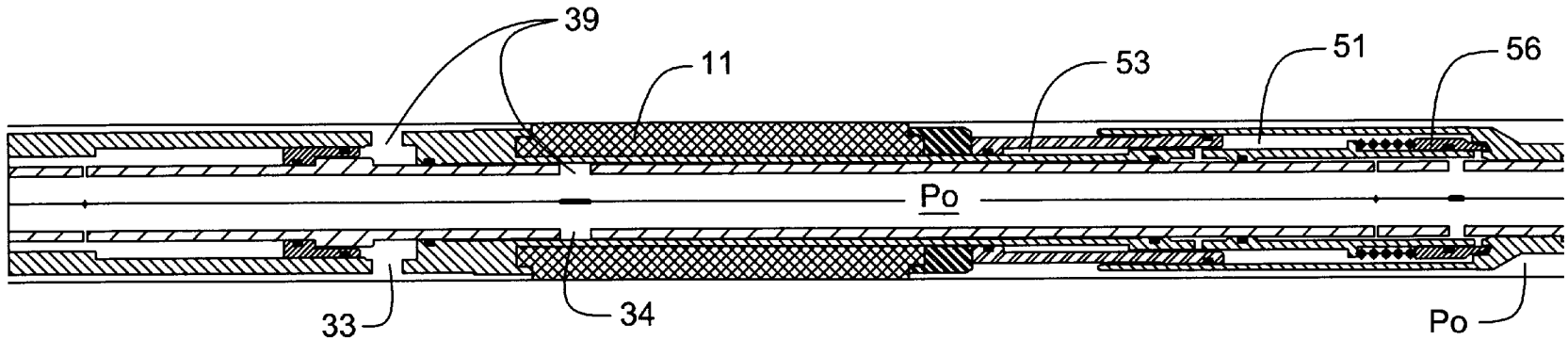
Fig. 6b OPERATIONS (e.g. ACIDIZE)

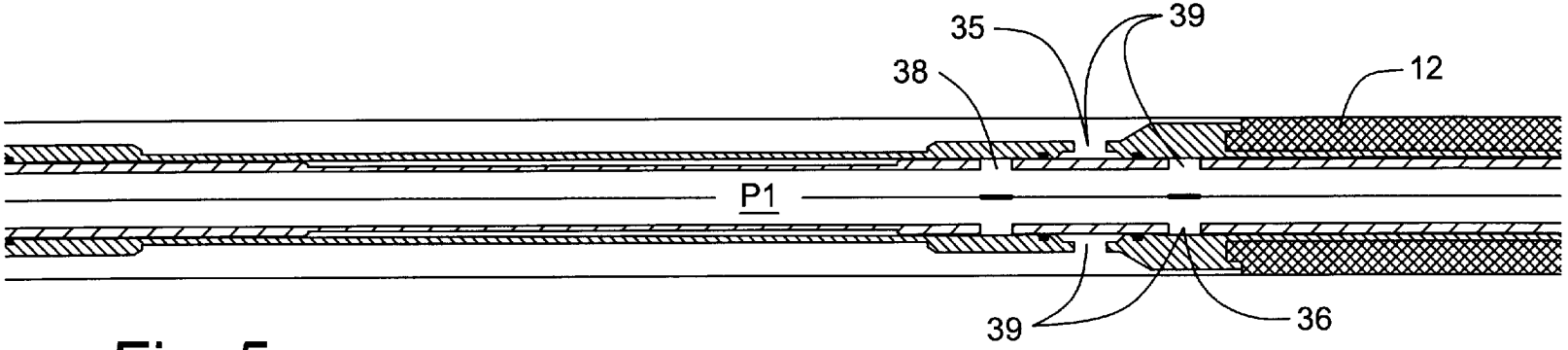
Fig. 5c SET
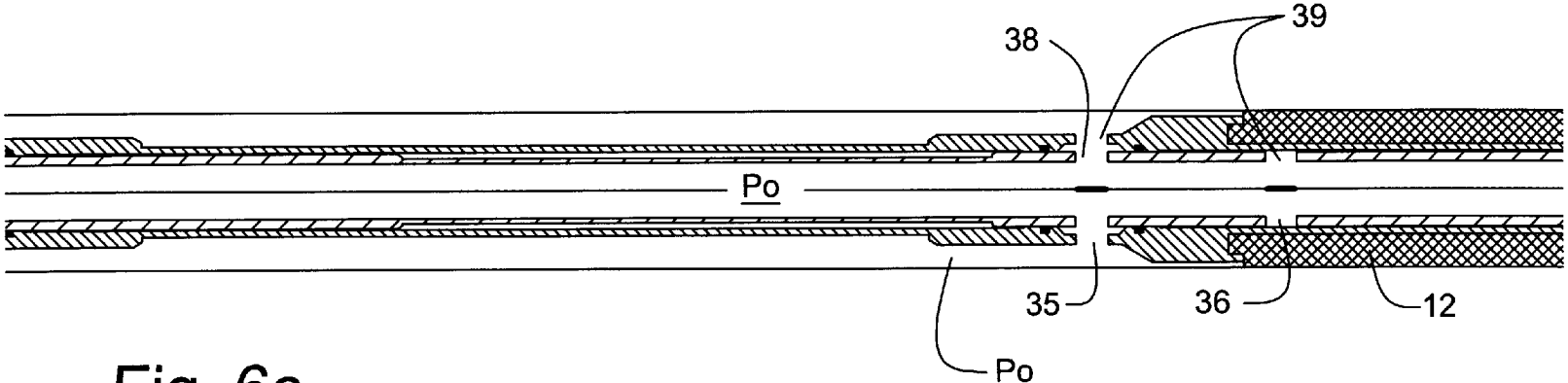
Fig. 6c OPERATIONS (e.g. ACIDIZE)

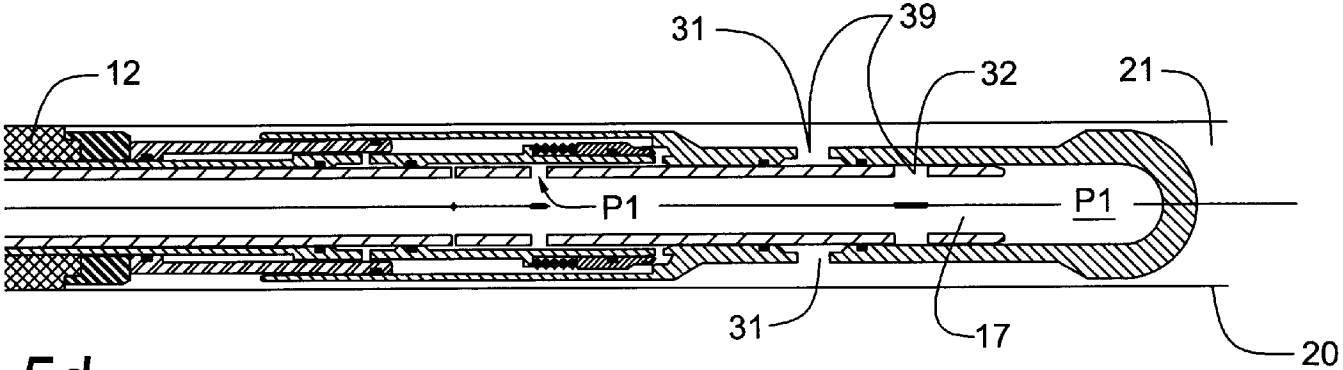
Fig. 5d SET
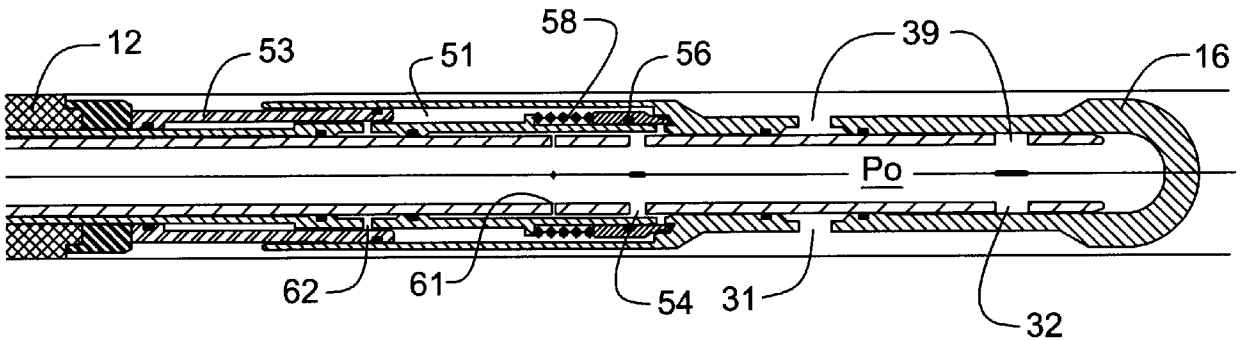
Fig. 6d OPERATIONS (e.g. ACIDIZE)

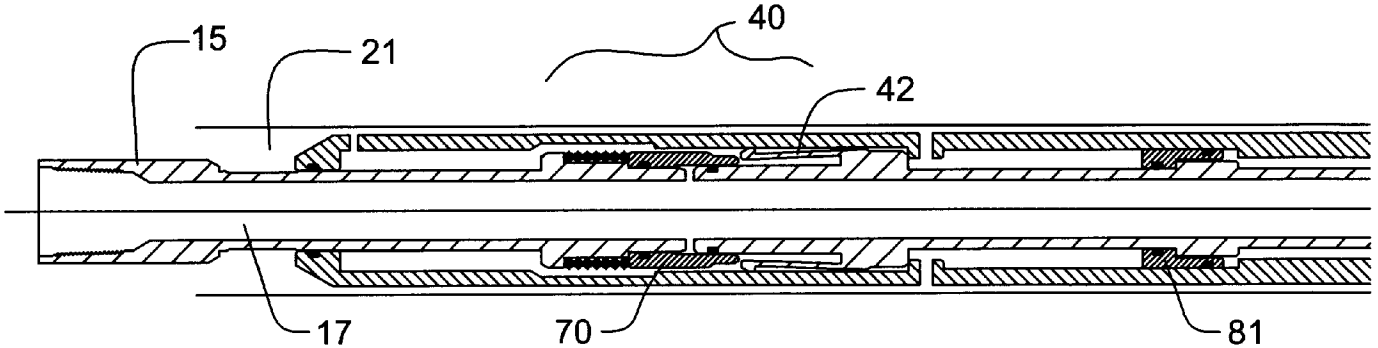
Fig. 7a SWAB
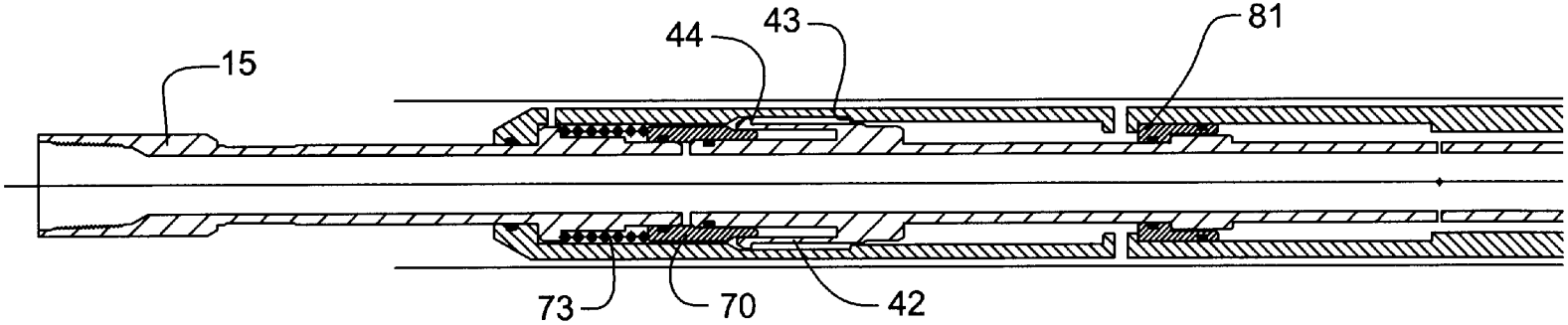
Fig. 8a RUN OUT

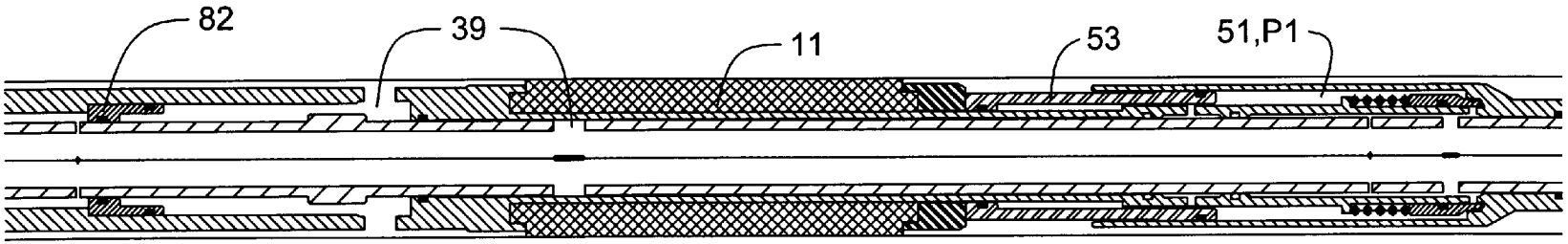
Fig. 7b SWAB
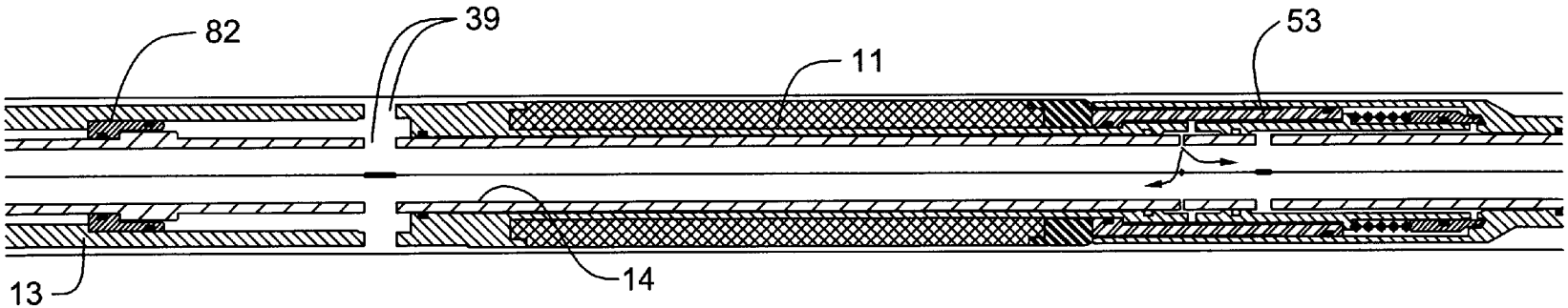
Fig. 8b RUN OUT

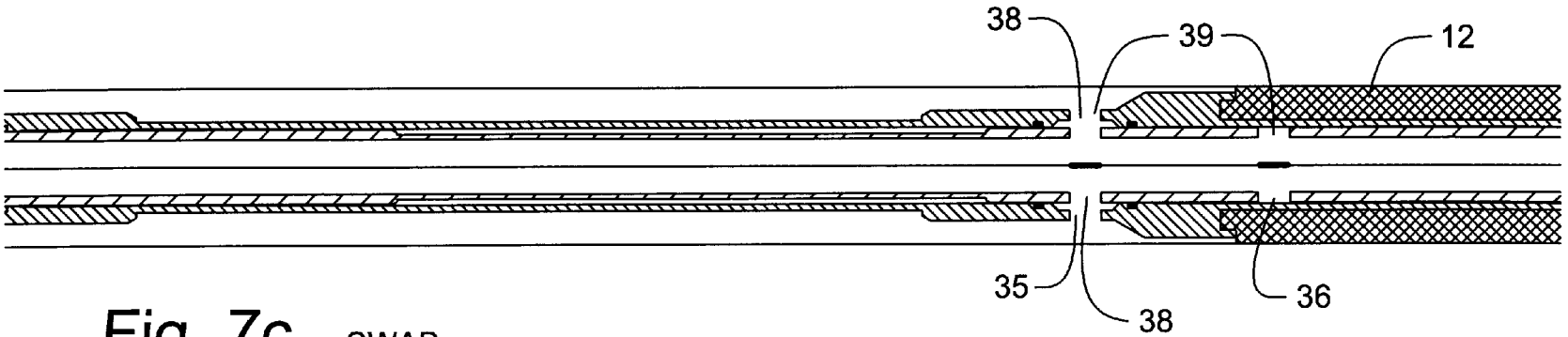
Fig. 7c SWAB
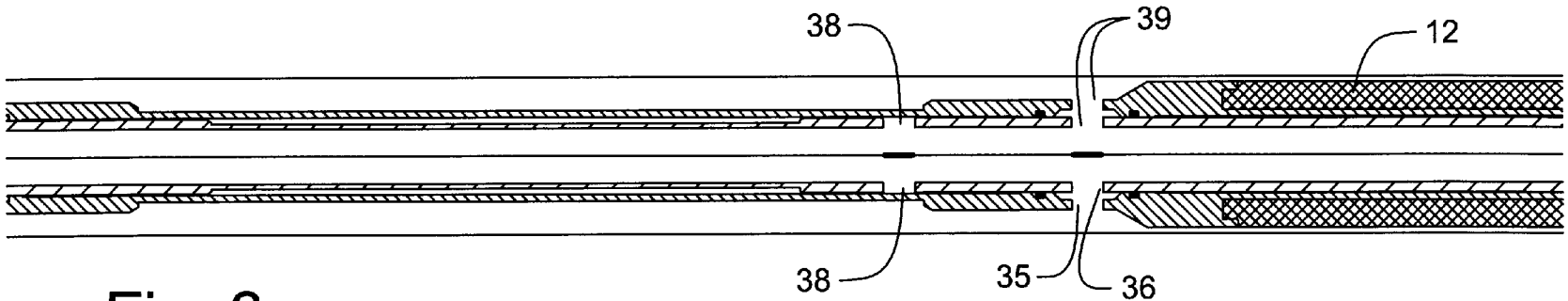
Fig. 8c RUN OUT

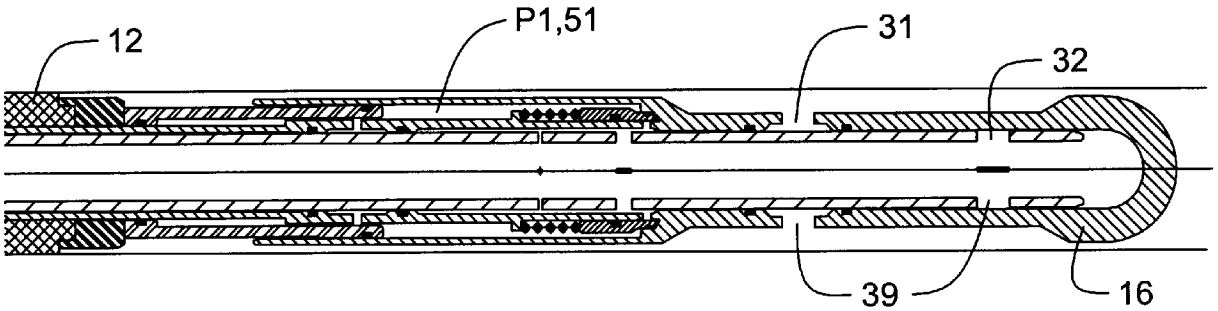
Fig. 7d SWAB
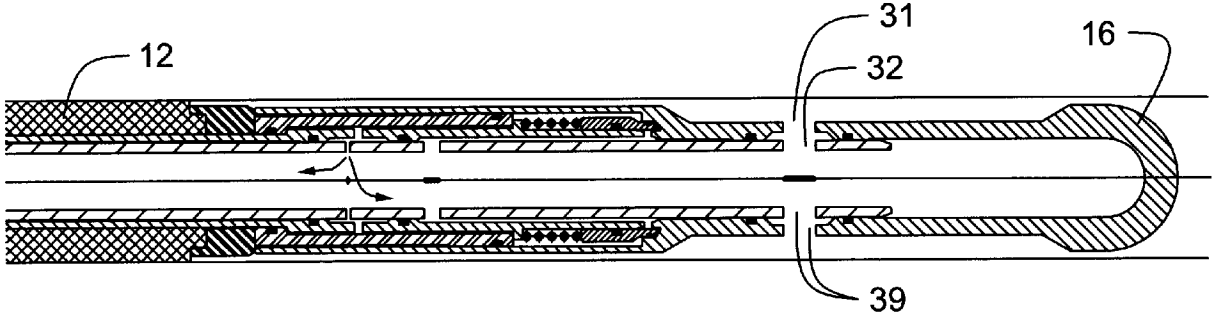
Fig. 8d RUN OUT

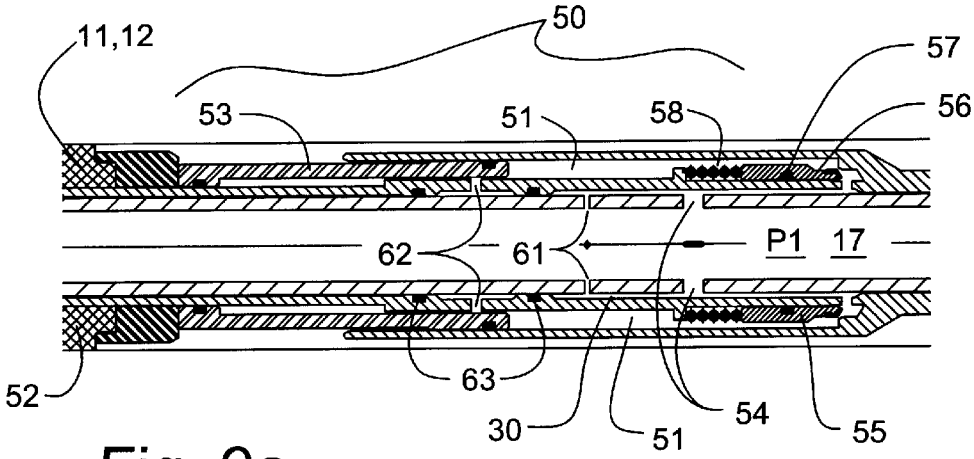
Fig. 9a SET
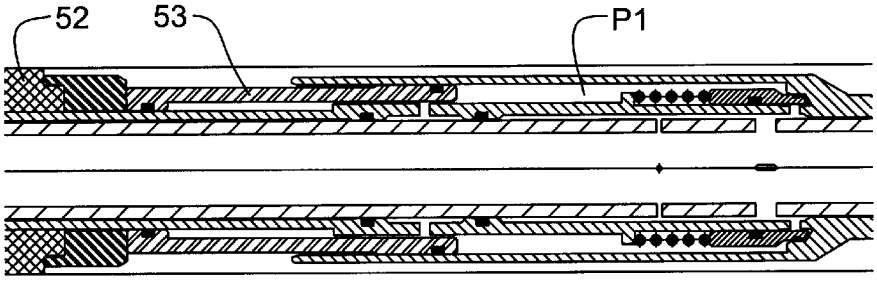
Fig. 9b OPERATIONS (e.g. ACIDIZE)
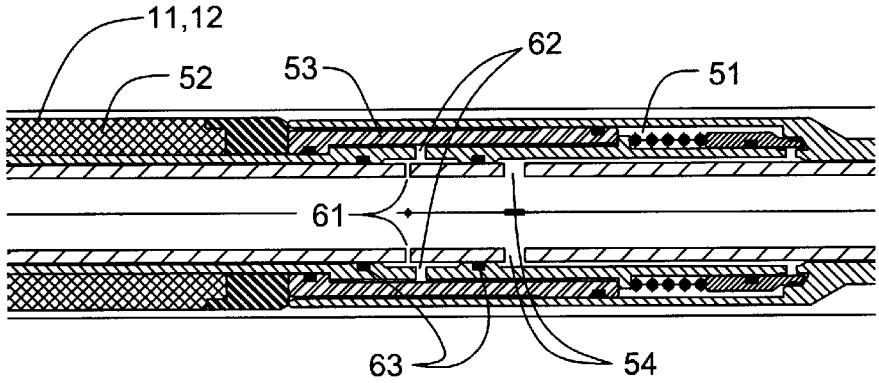
Fig. 9c RUN OUT

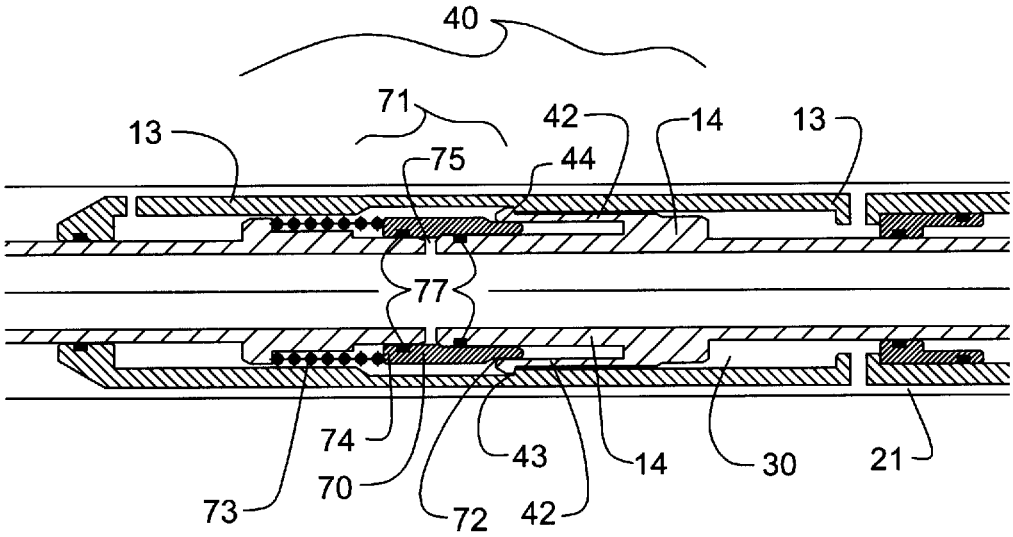
*Fig. 10a* RUN IN (HORIZONTAL)
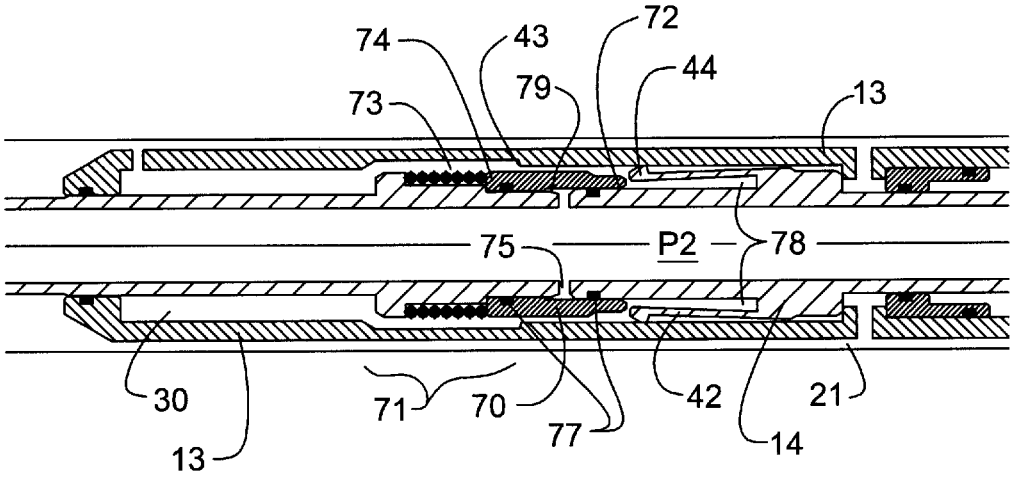
*Fig. 10b* OPERATIONS (e.g. ACIDIZE)

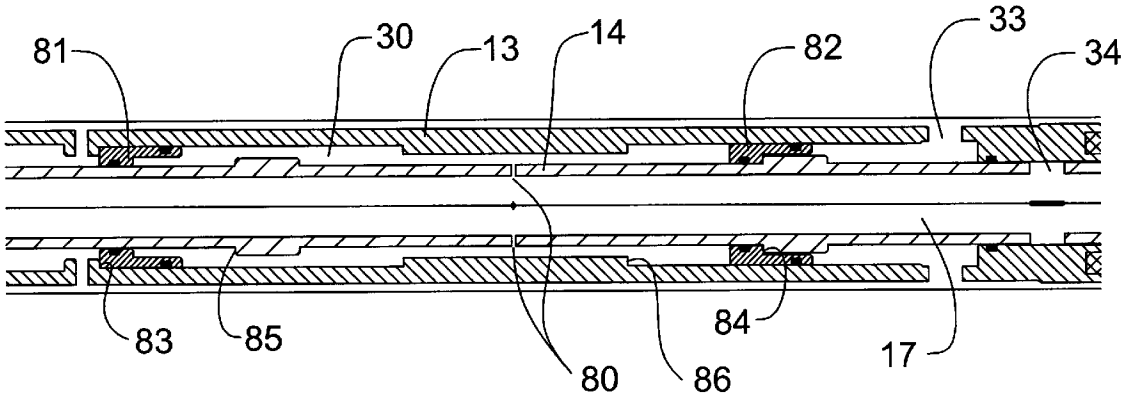
Fig. 11a SET
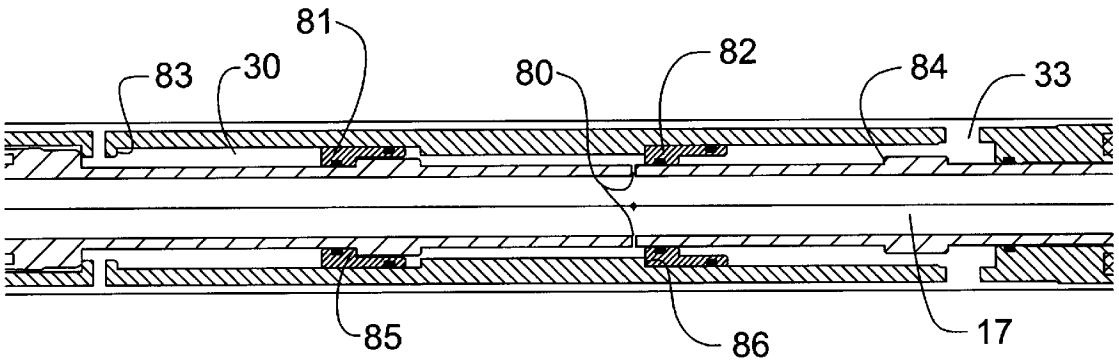
Fig. 11b SWAB

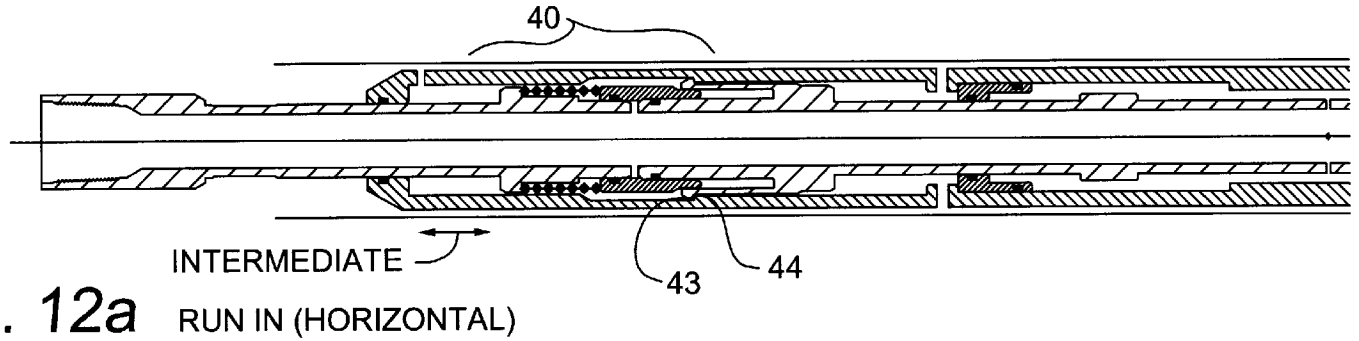
Fig. 12a RUN IN (HORIZONTAL)
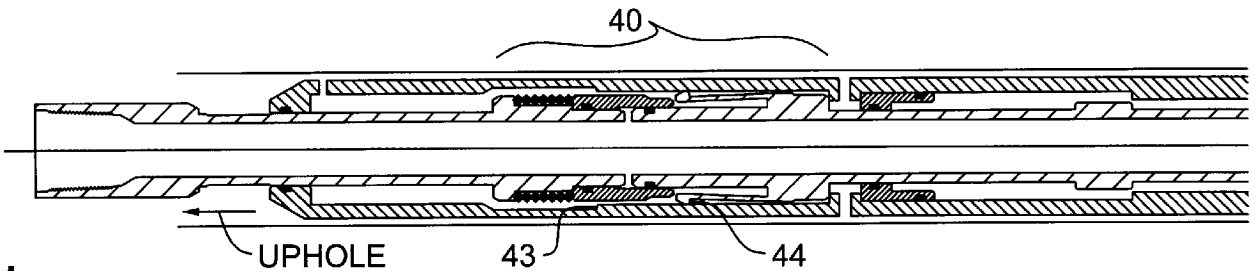
Fig. 12b OPERATIONS (e.g. ACIDIZE)
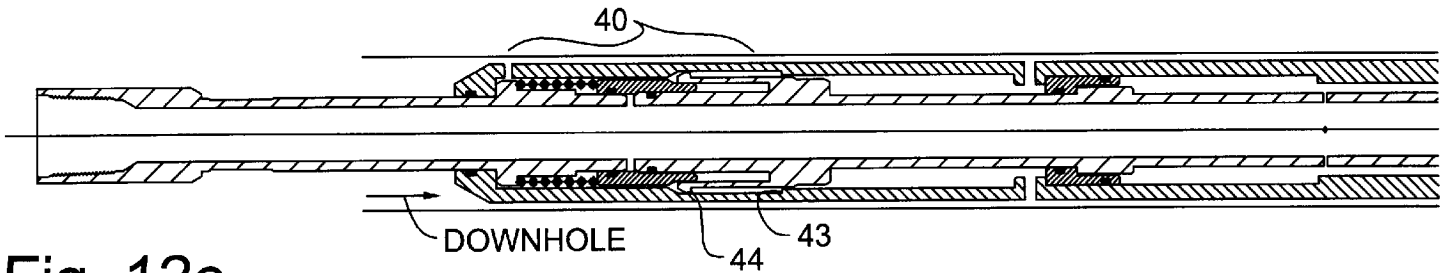
Fig. 12c RUN OUT

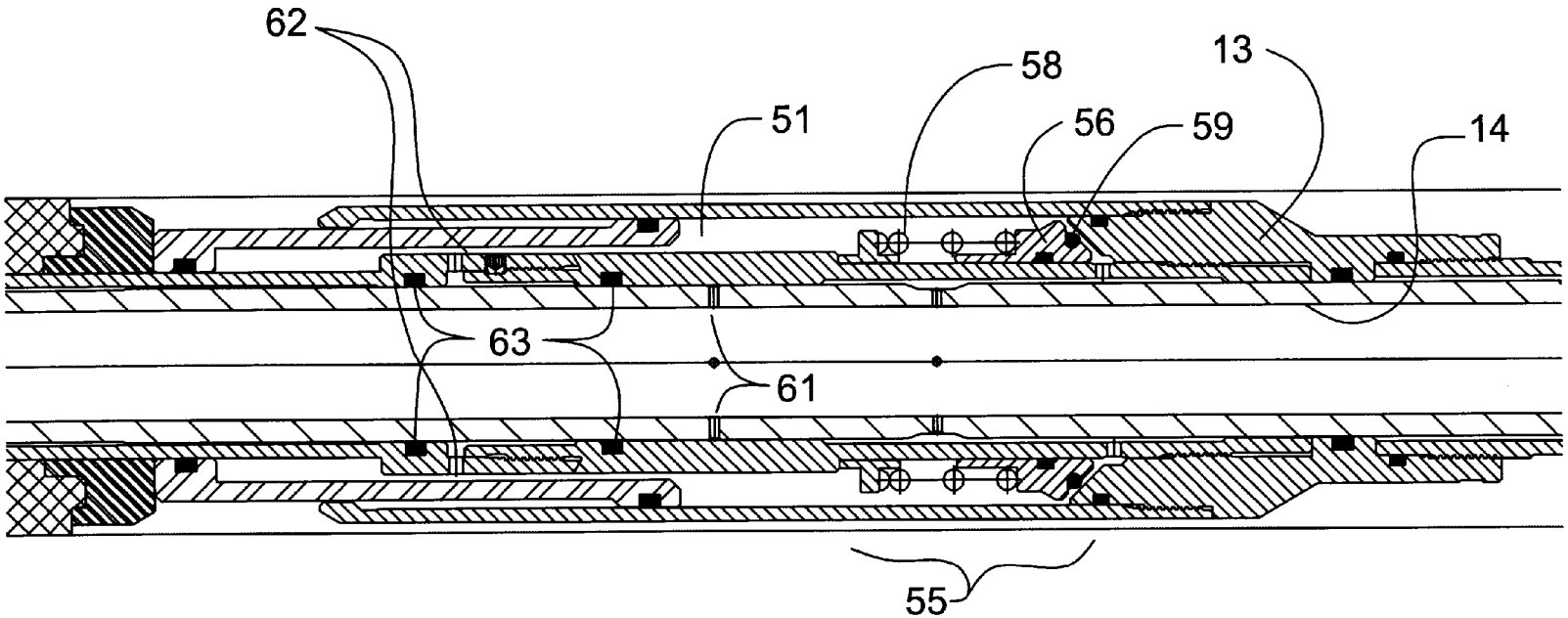
Fig. 13 SET

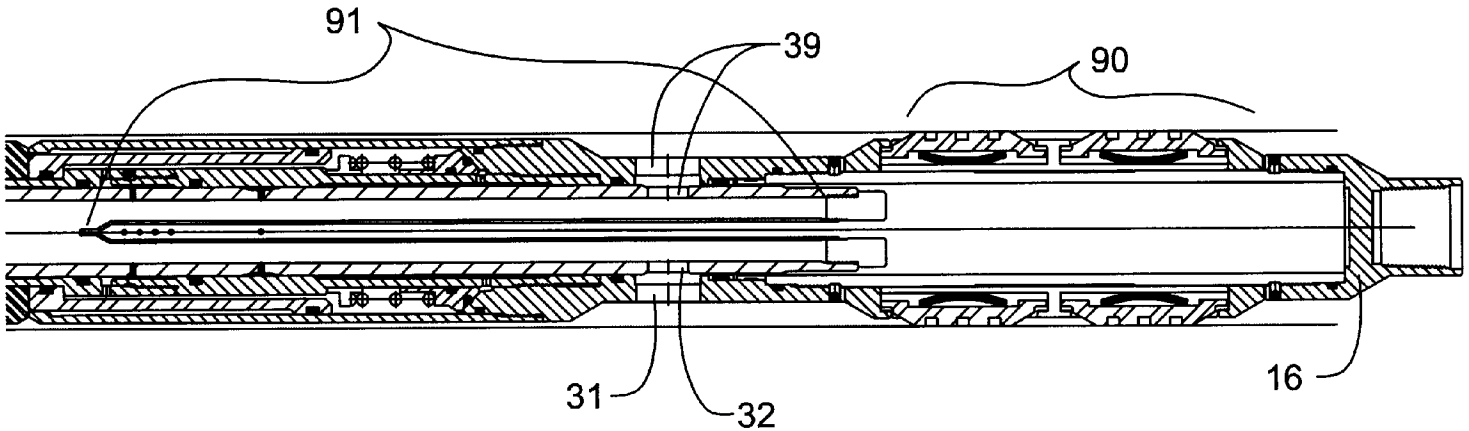
Fig. 14a RUN IN (BYPASS OPEN)
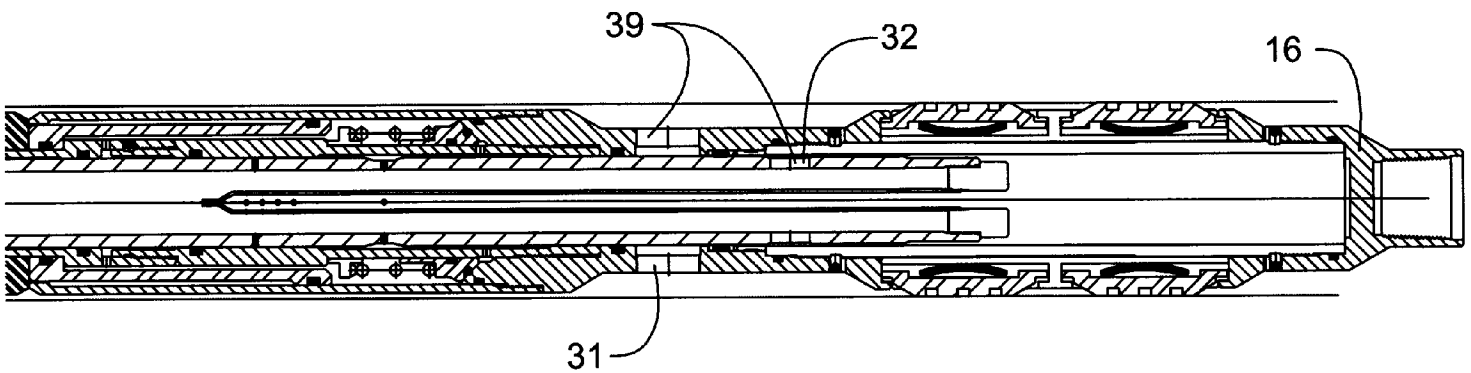
Fig. 14b RUN IN (BYPASS CLOSED)

OPEN HOLE STRADDLE TOOL

FIELD OF THE INVENTION

The present invention relates to well downhole tools having tubing with a fluid bore and packers which isolate a zone of a cased or uncased wellbore and for controlling communication between the isolated zone and the tubing.

BACKGROUND OF THE INVENTION

It is known to use a tool which straddles and isolates a zone in a well. One such tool is that described in U.S. Pat. No. 5,782,306 to Serafin. The tool utilizes inflatable packers spaced on a length of tubing, the packers being inflatable through a valve which shuts when the packers fully engage the well wall, and which then opens a fluid path between the tubing's bore and the now isolated zone. There are challenges in applying such known technology to horizontal wells including that the downhole end of the tubing string becomes relatively insensitive to tubing manipulation and only gross movements are effective. There are also reliability issues when applying remote actuation systems such as umbilicals or darts for instructing a downhole tool. It has been generally found that there are several challenges yet to be overcome in running in, setting and operating these prior art forms of tools in a variety of onerous wellbore conditions, including:

- use in horizontal wells which requires operations at remote locations and which are relatively insensitive to many conventional modes of tool operation including uphole/downhole movement, rotation, and tubing set-down weight;
- where running in results in a higher pressure leading the tool than that trailing the tool;
- where running in results in increasing differential pressures across various sealed components of the tool; and
- where there is often a desire to set, release, move and reset the tool so as to stimulate or produce from other areas of the wellbore as conditions change.

There is also a desire for a tool which is able to handle the above challenges while being reliable in its setting; in other words, it is not inadvertently actuated during the run in, or on the trip out. Further, with the difficulties imposed by a typical horizontal open hole wellbore, it is also desirable to avoid use of unreliable tubing manipulation and mechanical means such as umbilical connections.

SUMMARY OF THE INVENTION

The tool of the present invention utilizes tubing to annular pressure differential to effect actuation of at least two spaced packers for straddling or isolating a zone in a wellbore. For open hole wellbore, the packers are large radially movement capable, such as segmented squeezable or inflatable packers. Uphole and downhole packers are positioned and spaced apart on a cylindrical spool or housing extending concentrically along a length of mandrel. The length of tubing between the packers determines the interval or length of zone which is affected. A wellbore annulus is formed between the housing and the open hole. A tool annulus is formed between the housing and the tubing. Within the tool annulus are formed a variety of annular shoulders, pistons and other devices which enable unique capabilities and operations. The tool can be used to enable a variety of zone isolated operations including: production out of the zone, stimulation into the zone, and swabbing operations.

The tool is operable without the need for precise tubing manipulation. Tubing manipulation positions the tool by running in and pulling out. In combination with varying the tubing pressures and gross manipulation of lifting and lowering the tubing, pressure differentials during running in and tripping out can be equalized, packers can be set and released, operations in specific zones or intervals can be performed and the tool can be relocated in the wellbore.

As the present tool does not need tubing rotation for actuation or operation, the tool is particularly well suited for coiled tubing operation where tubing rotation is not possible. Further, in horizontal wells where set down weight cannot be reliably gauged, the present tool is still operable. Further, the mechanisms in the tool annulus enable use of the entire diameter of the tubing bore for fluid flow, avoiding placing restrictive constraints on the tubing bore.

In another aspect, the tubing, housing and tool annulus are implemented in combination with a novel arrangement of annular retaining pistons, shoulders and a mechanical movement limiting stop, preferably a collet and spring-biased pressure actuated sleeve. The stop and annular retaining pistons enable various operations including subsequent operations pressure fluctuations or reversals without releasing the tool. Through application of a threshold pressure, a sleeve shifts and removes collet support. The collet is permitted to flex or collapse and thereby remove the stop. Release of the stop allows the mandrel to move further downhole in the housing for aligning ports therebetween and opening fluid flow to the zone between set packers. Movement of the mandrel uphole relative to the housing allows release of the packers and resetting of the collet stop in preparation for tripping out of the wellbore, or repositioning the tool. The stop and the tool can be reset using a gross axial movement of the tubing and mandrel.

In one broad aspect, a method is provided for establishing fluid communication with an isolated zone of a wellbore comprising: providing a tool having a mandrel and a housing, the mandrel having a bore and being adapted at an uphole end for connection to a tubing string and being closed at a downhole end, and the housing carrying an uphole packer spaced axially along the housing from a downhole packer, the housing being movable axially on the mandrel; positioning the housing on the mandrel at a first position for establishing fluid flow from the wellbore below the downhole packer, through the bore of the mandrel and to the wellbore above the uphole packer for running in the tool; positioning the housing on the mandrel position at a second position for blocking fluid flow between the bore of the mandrel and the wellbore above and below the packers and applying a first pressure in the bore of the mandrel to actuate the uphole and downhole packers and isolate the zone therebetween; and positioning the housing at a third position for maintaining actuation of the packers, for continuing to block fluid flow between the wellbore above and below the packers and for establishing fluid flow between the bore of the mandrel and the isolated zone. In another embodiment, at the third position, the method further comprising: misaligning outer bypass ports in the housing and inner bypass ports in the mandrel for continuing to block fluid flow between the wellbore above and below the packers; and aligning outer operation ports in the housing and inner operation ports in the mandrel for establishing fluid flow between the bore of the mandrel and the isolated zone.

BRIEF DESCRIPTION OF THE DRAWINGS

FIGS. 3*a*–3*d* are four contiguous cross-sectional drawings, on four consecutive sheets, of the length of a tool, according to the embodiment of FIGS. 1*a*,1*b*, shown in an insertion or run in mode, illustrated as it may appear run in a vertical portion of the wellbore. In the figures, an uphole end of the tool is to the viewer's left and the downhole end is to the right;

FIGS. 4*a*–4*d* are four contiguous cross-sectional drawings of the length of the tool of FIGS. 3*a*–3*d* illustrated as it may appear run in a horizontal portion of the wellbore, or at a zone location;

FIGS. 5*a*–5*d* are four contiguous cross-sectional drawings length of the tool of FIGS. 3*a*–3*d* in a packer setting mode;

FIGS. 6*a*–6*d* are four contiguous cross-sectional drawings of the length of the tool of FIGS. 3*a*–3*d* in an operation mode, such as acidizing or production;

FIGS. 7*a*–7*d* are four contiguous cross-sectional drawings of the length of the tool of FIGS. 3*a*–3*d* in a swabbing mode;

FIGS. 8*a*–8*d* are four contiguous cross-sectional drawings of the length of the tool of FIGS. 3*a*–3*d* in a retrieval, trip out, run out or resetting mode;

FIGS. 9*a*–9*c* are sequential cross-sectional views of a packer according to FIGS. 1*a*,1*b* and operation of a poppet valve for actuating the packer, maintaining the packer setting during operations, and releasing the packer respectively;

FIGS. 10*a* and 10*b* are sequential cross-sectional views of the collet release mechanism for running in and for operations respectively;

FIGS. 11*a* and 11*b* are sequential cross-sectional views of annular retaining pistons in setting and swabbing modes respectively; in both cases the housing is driven uphole relative to the mandrel;

FIGS. 12*a*–12*c* are sequential cross-sectional views of the tool in the intermediate, uphole and downhole positions for running in, for operation; and for resetting the tool during retrieval or relocation respectively;

FIG. 13 is a cross-sectional view of the tool according to FIGS. 2*a*,2*b* illustrating an alternate configuration of a packer actuating chamber and poppet valve; and FIGS. 14*a*–14*b* are sequential cross-sectional views of the downhole end of the a tool according to the embodiment of FIGS. 2*a*,2*b* illustrating an integral debris catcher in the mandrel and a drag block arrangement on the housing.

DETAILED DESCRIPTION OF THE PREFERRED EMBODIMENT

Figure 1A:
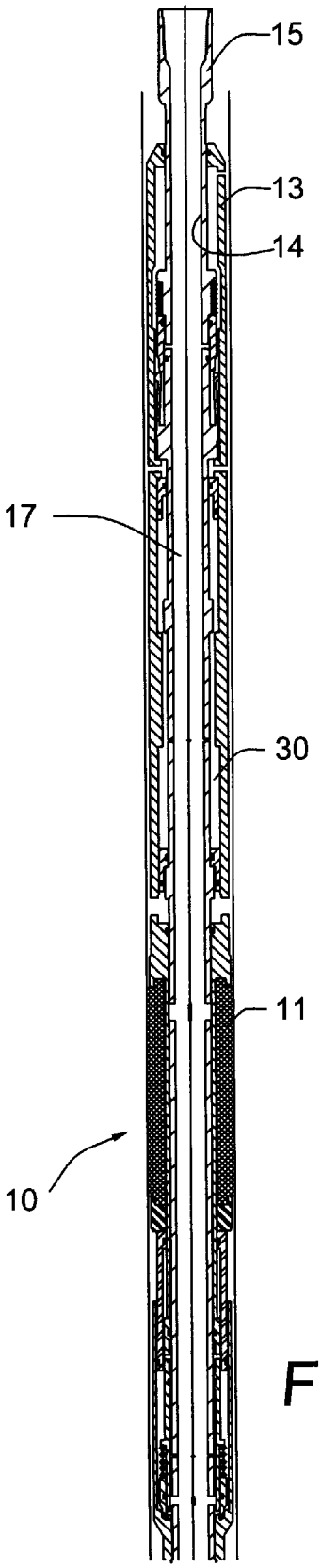
FIGS. 1*a* and 1*b* are contiguous cross-sectional drawings of one embodiment of the tool in a straddle-packer operation mode for communication of fluid pressure in the tool's bore and the selected interval or zone.
Figure 1B:
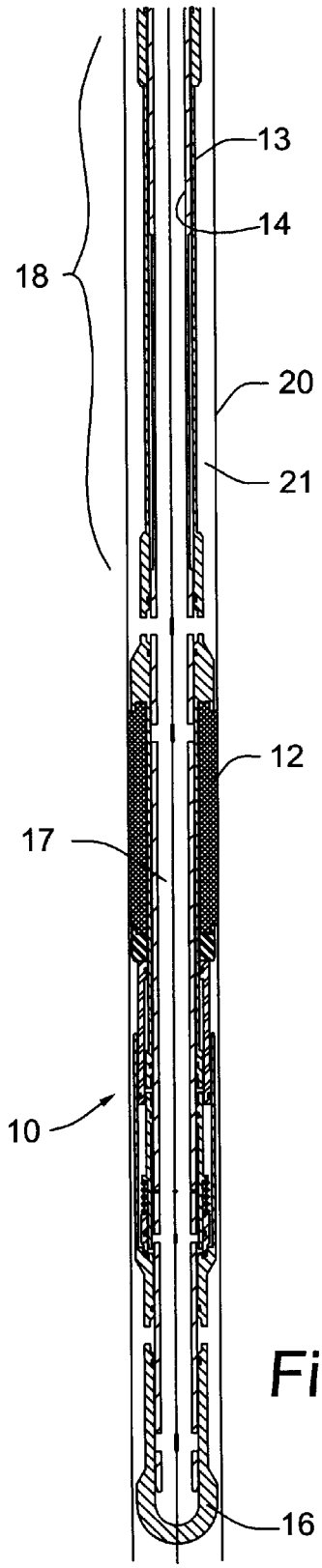

With reference to an overall view of one embodiment in FIGS. 1*a* and 1*b*, a straddle packer tool 10 is provided having at least two packers; an uphole packer 11 and a downhole packer 12. Advantageous for open hole use, the packers 11, 12 can be open hole capable such as squeezable or inflatable packers. The packers 11,12 are positioned and spaced apart on a housing 13 extending concentrically along a length of tubing or mandrel 14. The mandrel 14 is adapted at an uphole end 15 for connection to a tubing string extending uphole (not shown) and has a bore 17 in fluid communication with a bore of the tubing string. The mandrel 14 has a downhole end 16 which is adapted for closure so that fluid in the bore 17 can be pressurized. Variable lengths of a spool or tubing spacer 18 can be pre-assembled to axially space the packers 11,12 and thereby capture larger or smaller zone intervals of the wellbore 20. A wellbore annulus 21 is formed between the housing 13 and the open hole of the wellbore 20. A tool annulus 30 of variable section is formed between the housing 13 and the mandrel 14. Within the tool annulus 30 are formed a variety of annular shoulders, pistons and other devices which enable unique capabilities and operations described below.

The housing 13 and mandrel 14 are axially movable with respect to each other. Unless the context suggests otherwise, it is understood that the movement is relative and may be initiated through movement of either the mandrel 14 or the housing 13 although only for assisting in consistency in the description, the movement is usually described in terms of movement of the housing 13. That said, the housing 13 is movable to various positions for opening and closing a fluid bypass around the packers 11,12, for alternately actuating and releasing the packers, for swabbing operations and for performing operations on the zone between packers.

Figure 2A:
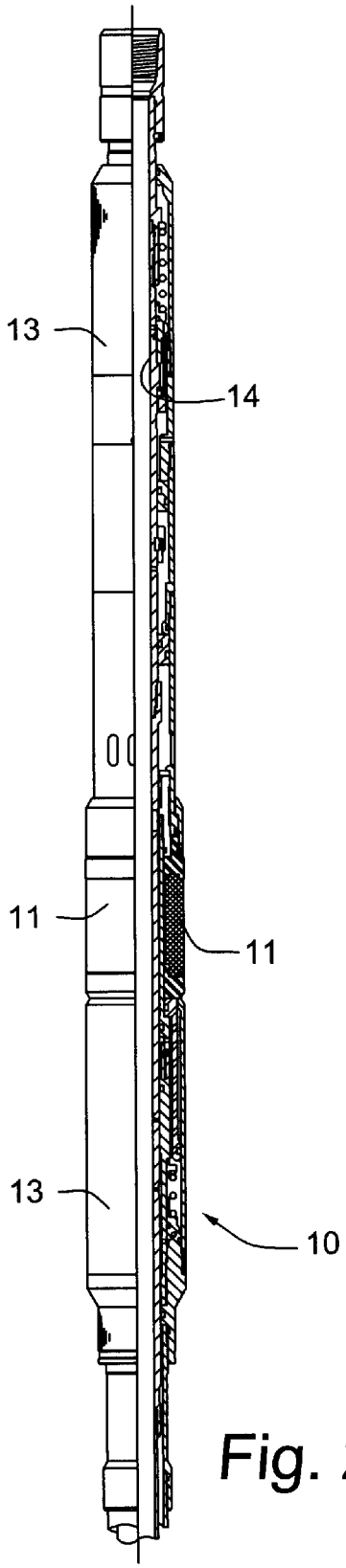
FIGS. 2*a* and 2*b* are contiguous cross-sectional drawings of another embodiment of the tool having drag blocks attached thereto, in a resetting mode for releasing the packers and resetting a limiting stop.
Figure 2B:
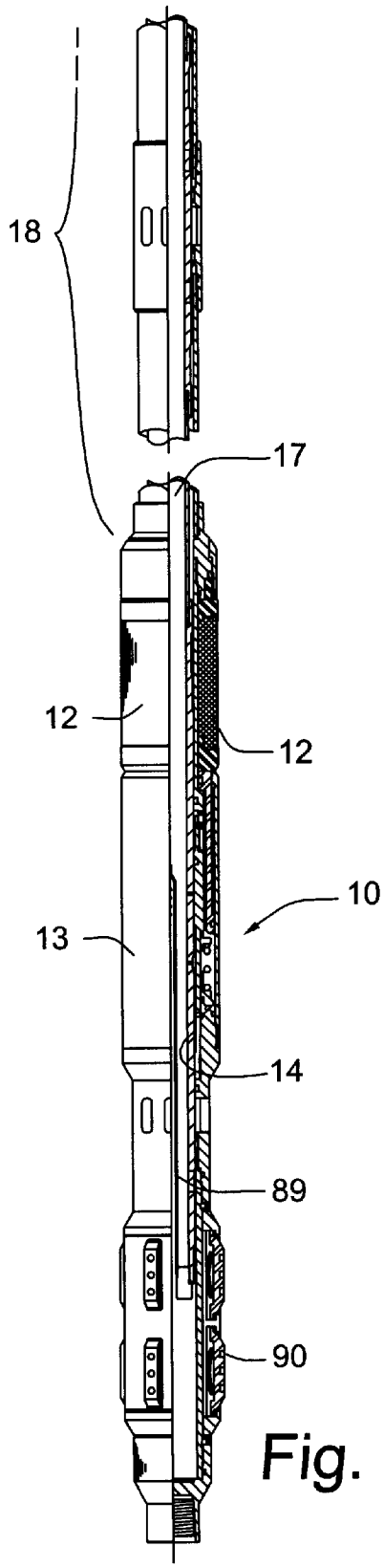
Figure 2C:
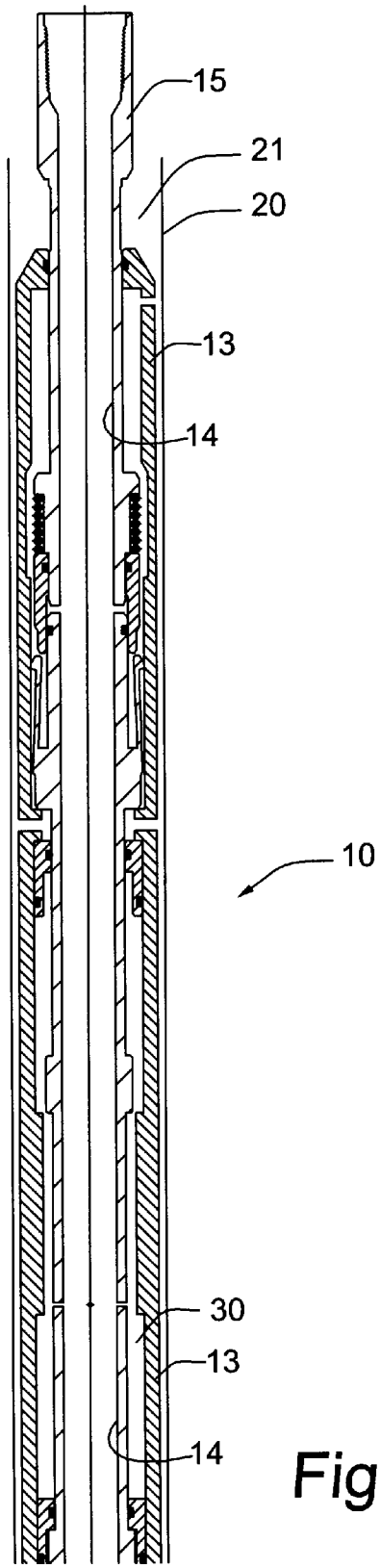
FIGS. 2*c*–2*f* are four contiguous cross-sectional drawings of the embodiment of FIGS. 1*a*, 1*b* arranged from an uphole to a downhole end.

In a second embodiment shown in FIGS. 2*a*,2*b*, the tool 10 is shown incorporating a variety of alternate configurations and components to achieve the same end, all of which are described in greater detail below, such as arrangement of the tubing spacer 18, the means for actuating the packers, a debris catcher 89 at the downhole end 16 of the mandrel 14 and a drag block arrangement 90 at the downhole end of the housing 13.

Figure 2D:
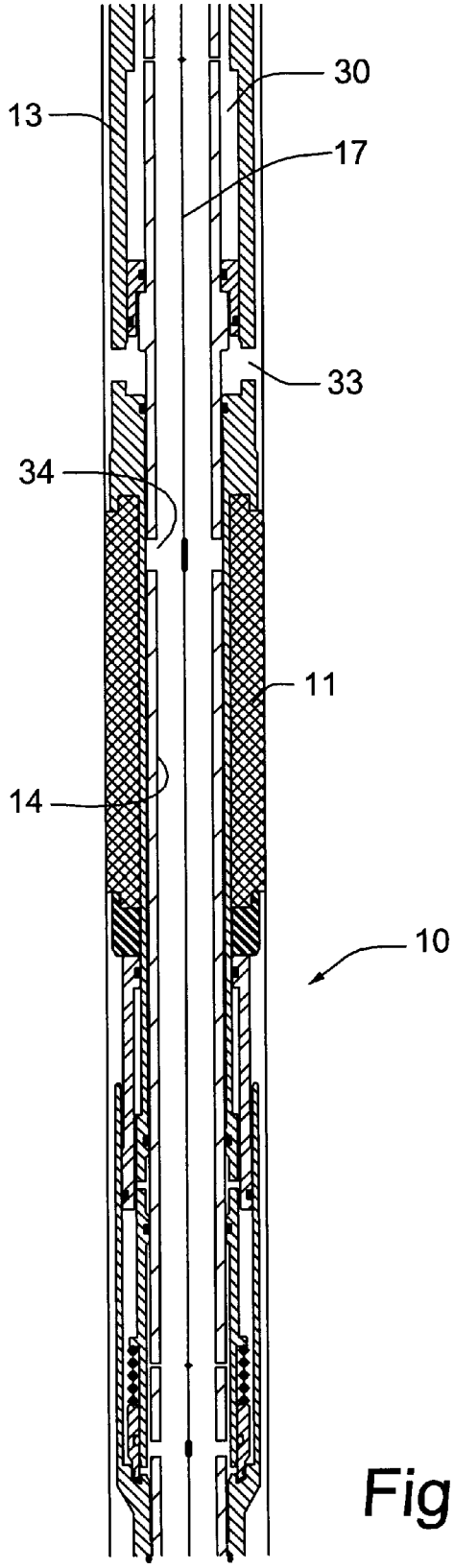
Figure 2E:
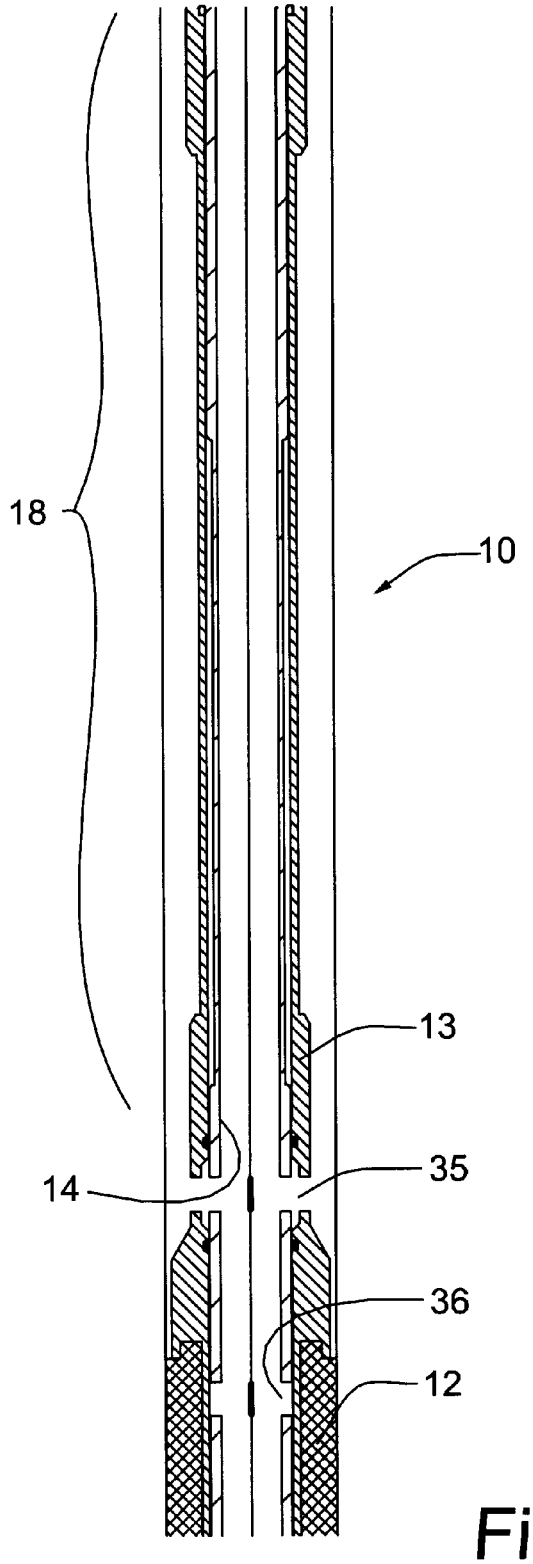
Figure 2F:
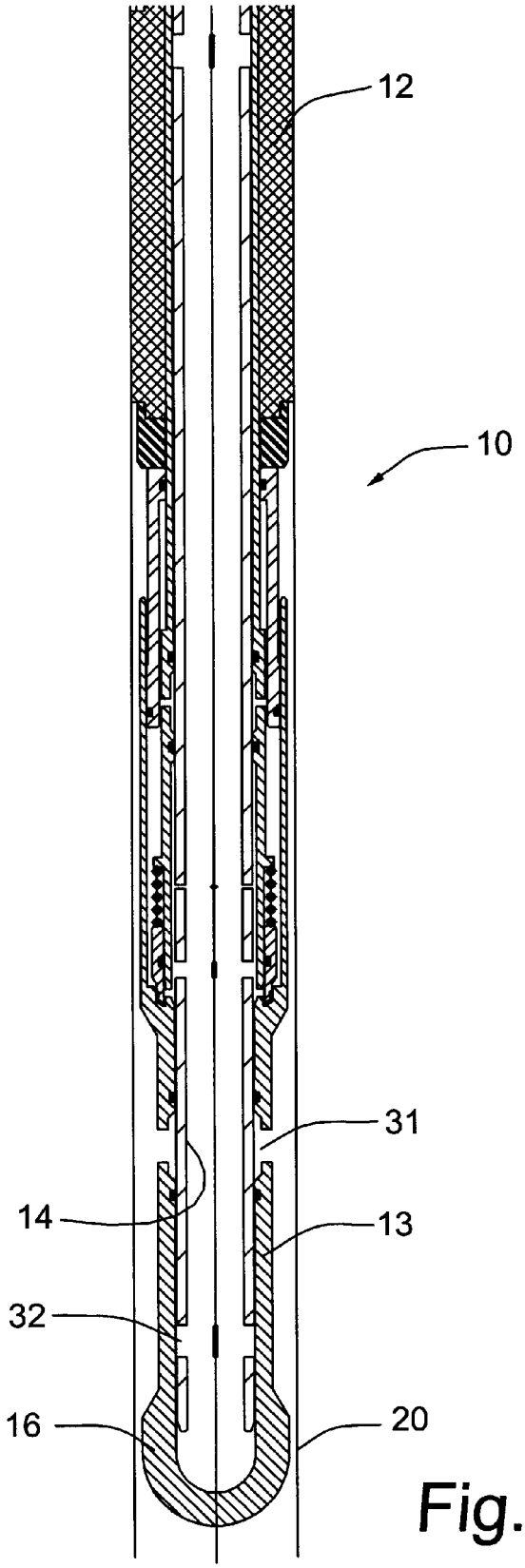

Returning to the first embodiment of FIGS. 1*a*,1*b*, and set forth in greater detail in FIGS. 2*c*–2*f*, the tool 10 further comprises a series of bypass ports which enable fluid communication between the wellbore 20 and the mandrel's bore 17. In FIG. 2*f*, below the downhole packer 12, an outer leading port 31 is formed in the housing 13 which can be aligned for fluid communication with an inner leading port 32 into the bore 17 of the mandrel 14. Each cooperating outer and inner port can be individual cooperating ports or a plurality of cooperating ports whether or not they are referred to in singular or plural. When aligned the mandrel's bore 17 is in fluid communication with the wellbore annulus 21. In FIG. 2*d*, above the uphole packer 11, an outer trailing port 33 in the housing 13 can be aligned for fluid communication with an inner trailing port 34 to the mandrel's bore 17. While not a requirement, additional bypass ports can be provided as shown in FIG. 2*e*. Along the tubing spacer 18 there can be outer intermediate port 35 and an inner intermediate port 36 formed in the housing 13 and mandrel 14 respectively, located between the uphole and downhole packers 11,12. Collectively or in pairs, the ports 31,32 and 33,34 and 35,36 are referred to as bypass ports. The bypass ports can be alternated between aligned and misaligned relationship.

With reference to FIGS. 3*a*–8*d* and corresponding reference to FIGS. 2*c*–2*f*, the tool 10 is now further described in the context of various modes of operation as follows.

Running In

Having reference to FIGS. 3*a*–3*d*, during running in the wellbore 20, the position of the housing 13 is placed at a downhole position relative to the mandrel so that the bypass ports 39 are aligned and fluid flow is enabled therethrough for establishing fluid communication between the wellbore and the bore 17 of the mandrel 14. Equalized pressure aids in minimizing or preventing inadvertent actuation of fluid pressure actuated components such as the packers 11,12. Accordingly, fluid pressure is substantially equalized between the mandrel's bore and the wellbore uphole and downhole of the tool. The outer leading port 31 (FIG. 3*d*) in the housing 13, is periodically or occasionally aligned for fluid communication with the inner leading port 32 in the mandrel 14. The outer trailing port 33 (FIG. 3*b*) in the housing 13, is periodically or occasionally aligned for fluid communication with the inner trailing port 34 in the mandrel 14. The aligned leading ports 31,32, bore 17 and aligned trailing ports 33,34, collectively bypass ports 39, form a fluid bypass around both packers 11,12 to avoid pressure differential between the wellbore annulus 21 and the bore 17 during running in. Where the position or relative movement between the housing 13 and mandrel 14 is not otherwise serendipitous so as to align the bypass ports, the mandrel 14 may be occasionally lifted during running in to shift the housing 13 downwardly to the downhole position relative to the mandrel 14 for aligning the outer and inner ports 31,32 and 33,34. Where one may wish to equalize pressure either side of each packer 11,12, as shown in FIG. 3*c*, one may incorporate the outer intermediate 35 and inner intermediate ports 36 formed in the housing 13 and mandrel 14 respectively and which are similarly aligned collectively with leading and trailing ports 31,32 and 33,34, at least periodically, to equalize pressure in the mandrel bore 17 and between the packers 11,12.

Alignment of the inner and outer ports 31,32 and 33,34 and 35,36, is achieved by aligning the axial positions of the housing 13 and mandrel 14. In the embodiment shown, the housing 13 is shown in the downhole position which aligns the bypass ports 39.

At Location Adjacent the Zone

Having reference to FIGS. 4*a*–4*d*, either during running in or once run in to the desired zone, interval or location, relative movement results in the housing 13 either moves or being moved uphole to an intermediate position from the downhole position (FIGS. 3*a*–3*d*) relative to the mandrel 14. The housing 13 is prevented from free axial movement from the intermediate position to a further uphole position (FIGS. 6*a*–6*d*) due to a movement limiting means 40 such as a collet arrangement. A collet 41 is located somewhere along the tool annulus 30 for limiting relative movement therebetween and has a plurality of circumferentially spaced and axially extending fingers 42 which are cantilevered for releasable flexible engagement of catches 44 with a corresponding annular shoulder 43.

Briefly, and referring to FIGS. 12*a*–12*c*, the full range of movement of the housing 13 relative to the mandrel 14 is illustrated between the downhole and intermediate positions (FIG. 12*c*,12*b* respectively) and the uphole position once the catches 44 are displaced from the housing's shoulder 43.

In more detail, in the embodiment shown in FIGS. 10*a*, 10*b*, the fingers 42 are cantilevered from the mandrel 14 and the shoulder 43 is formed in the housing 13. In FIG. 10*a*, in the housing's intermediate position, distal ends of the collet fingers 42 have outward catches 44 which engage with the inward shoulder 43 formed in the housing 13. The fingers' outward catches 44 limit or stop the uphole motion of the housing 13 to the intermediate position so that the bypass ports 39 are misaligned and the mandrel's bore 17 is isolated from the wellbore annulus 21. In FIG. 10*b* as described below for operations, the outward catches 44 are released from the shoulder 43 for enabling movement of the housing to the uphole position.

Set Packer

With reference to FIGS. 5*a*–5*d*, with the housing 13 in the intermediate position for misaligning the bypass ports 39, a first internal pressure P1 in the mandrel bore 17 is provided for forming a differential pressure between the mandrel's bore 17 and the wellbore annulus 21 for actuating the uphole and downhole packers 11,12. For example, a typical pressure P1 provided by a surface pump would produce a downhole differential pressure of about 1000 psi.

With reference also to FIGS. 9*a*–9*c*, a sequence is illustrated wherein the packers 11,12 are set, maintained in the set condition, and finally released respectively. In this embodiment, packers 11,12 described herein comprise an annular actuating chamber 51 is formed in the housing 13 offset axially from an elastomeric packer element 52. The actuating chamber 51 enables filling of an inflatable packer or for actuation of a piston 50 to squeeze the elastomeric element 52 and displace them outwardly to engage the wellbore.

As shown in this embodiment, the chamber 51 contains an annular piston 53 which engages the packer element 52 for imposing an axial squeezing load. A fluid port 54 is provided for fluid communication between the mandrel's bore 17, across the tool's annulus 30 and to the chamber 51. A poppet valve 55 is arranged in the chamber 51 for alternately blocking or opening the fluid port 54. As shown in FIG. 9*a*, when the pressure reaches an actuating level, the poppet valve 55 lifts, enabling fluid flow through port 54 and into the actuating chamber 51 for driving the piston 53 and setting the packer 11,12. The poppet valve 55 is a one way valve comprising a sleeve 56, provided with a seal 57 on the port 54 side, and which is biased in the closed position, such as by a spring 58. The poppet valve 55 normally traps fluid pressure in the actuating chamber 51 for maintaining the packers 11,12 in a set condition until purposefully released. A suitable material for the spring 58 is an Inconel X 750.

Later, in a retrieving or tool-repositioning mode (FIGS. 9*c* and 8*a*–8*d* as described below), the movement limiting means 40 is reset as the housing 13 is moved to the downhole position and with the result that the packers 11,12 are caused to be released. When the housing 13 is moved to the downhole position, an inner release port 61 in the mandrel 14 is aligned with an outer release port 62 to the actuating chamber 51 for releasing fluid pressure trapped therein, allowing the piston 53 and packer element 52 to relax, disengaging the packer's 11,12 from the wellbore 20. The mandrel side of the chamber 51, spaced either side of the outer release port 62 is fit with seals 63, thereby retaining fluid pressure in the chamber 51 until the mandrel's inner release port 61 is aligned between the seals 63. Various seals are used throughout to seal pistons and sleeves in the tool. Suitable seals include O-rings, such as 90 Duro HNBR, in various sizes.

Operations in a Zone

Having reference to FIGS. 6*a*–6*d*, with the housing in the uphole position and with the packers 11,12 engaged, one can enable fluid flow in or out of the tubing string and mandrel bore 17 and into or out of the zone straddled by the packers 11,12, such as for stimulation into the zone or for production out of the zone at operations pressures Po. Movement of the housing 13 to the uphole position is normally limited by the movement limiting means 40.

With further reference to FIGS. 10*a*,10*b*, 12*a*–12*c*, to prepare for operation, a further increase in actuating fluid pressure in the mandrel 14 to a second pressure P2 is temporarily applied for releasing the movement limiting means 40 by overcoming a spring-biased and annular collet support piston or sleeve 70 located in the tool annulus 30, and which cooperates to support the collet 40 for limiting movement. A typical second pressure P2 would be about 2500 psi. Note that this 2500 psi also is applied to the packers 11,12 through the poppet valves 55 and maintained therein until released.

As shown in FIGS. 10*a* and 10*b*, the support sleeve 70 is located in the tool annulus 30 and which extends between the collet fingers 42 and the mandrel 14 for supporting and maintaining the outward catches 44 of the collet fingers 42 radially outwardly and in engagement with the shoulder 43 formed in the housing 13. The shoulder 43 is formed as the termination of an annular recess 71 formed in the housing 13. The recess 71 permits limited relative axial movement of the collet fingers 42 and housing 13 which correspond to the movement between the housing's downhole and intermediate positions. The collet catches 44 and housing shoulder 43 are engaged at the intermediate position during actuation of the packers 11,12. The support sleeve 70 has a downhole end 72 which is tapered so as to easily engage a finger annulus 78 formed between the collet fingers 42 and the mandrel 14. A spring 73 is positioned axially between an uphole end 74 of the support sleeve 70 for normally biasing the sleeve 70 downhole and into a collet-supporting role.

A port 75 is formed in the mandrel 14 and is in fluid communication with the sleeve 70. The sleeve 70 is positioned between the port 75 and the tool annulus 30. The tool annulus 30 is in fluid communication with the wellbore annulus 21. The diameters of the mandrel 14 and sleeve 70 are stepped so that the diameter of the mandrel 14 at the inside diameter of the uphole end 74 of the sleeve 70 is smaller than the diameter of the mandrel 14 at the sleeve's downhole end 72. As a result the sleeve 70 has a step forming a localized step or piston 79. Uphole and downhole seals 77, between the sleeve 70 and the mandrel, straddle the port 75. An increased second differential pressure in the bore 17 operates on the hydraulic surface of the piston 79 and produces fluid force driving the sleeve 70 uphole against the spring 73.

As shown in FIG. 10*b*, when the second pressure P2 acting on the piston 79 is sufficient to overcome the spring's bias for moving the sleeve 70 uphole to a second position, retracting the supporting sleeve 70 from the finger annulus 78 and thereby releasing the collet fingers 42 to flex radially inwardly. The housing's inward shoulder 43 is sloped downhole and therefore the collet's fingers 42 can flex inwardly and the catches 44 release from the housing's shoulder 43, also releasing the housing 13 to move uphole from the mandrel 14 to the uphole position.

An outer port such as the outer intermediate port 35 formed in the tubing spacer 18 portion of the housing 13 aligns with an operations port 38 in the mandrel 14, for establishing communication between the zone and the bore 17. The operations port 38 is spaced from the inner intermediate port 36. The bypass ports 39 are misaligned. The tool 10 remains in this operation mode regardless of the direction or magnitude of the pressure P1,P2,Po applied.

With reference to FIGS. 11*a*,11*b*, relative movement or prevention of movement of the housing 13 and mandrel 14 under various fluid pressures are assisted using cooperating retaining pistons.

A further port 80 in the mandrel 14 communicates between uphole and a downhole annular retaining pistons 81,82, located in the tool annulus 30 and sealing between the housing and mandrel. The retaining pistons 81,82 are driven apart to uphole and downhole positions respectively by positive differential fluid pressure communicating through the port 80 located intermediate between the two retaining pistons 81,82. Negative differential pressure drives the retaining pistons 81,82 together to downhole and uphole positions respectively.

As shown in FIG. 11*a*, under positive pressure such as under limit stop support piston 70 releasing second pressures P2, the uphole retaining piston 81 moves uphole to engage an inward shoulder 83 extending from the housing 13 and which cooperate to drive the housing 13 uphole. Further, the downhole retaining piston 82 move downhole to engages an inward shoulder 84 extending from the mandrel 14 and which further cooperates to drive the mandrel downhole. Accordingly, the retaining pistons 81,82 drive the housing 13 uphole relative to the mandrel 14. As described previously, due to release of the limit stop 40, this is a greater relative movement than was possible in the running-in configuration or downhole position.

Swabbing

Once the housing 13 is in the uphole position for operations, and having reference to FIGS. 7*a*–7*d*, one particular form of operation which is challenging is the swab test in which the pressure Po in the bore 17 and the zone is cycled. In the uphole position and when the outer intermediate 35 port is aligned with the operations port 38, cycling of the pressure means the differential pressure Po between the mandrel's bore 17 and the wellbore annulus 21 reverses, however it is an objective to ensure that the bore 17 and zone remain in communication without accidental movement of the housing 13 relative to the mandrel 14. Relative movement at this time could inadvertently align and open the bypass ports 39. A scheme for actuating the various components (packers 11,12, collet sleeve 70) must be able to work under such variable operational pressures Po without changing their actuation from the operational mode to another mode including a setting, a packer releasing or a running mode.

In this situation, the tool 10 has the following ports which are affected: the port 80 to the retaining pistons 81,82, the ports 54,62 to the packers 11,12 which are still directionally blocked by the poppet sleeve 56; and the aligned outer and inner intermediate ports 35,36.

The zone access ports 35,38 are clearly intended to be involved and remain aligned for passing pressure variation and affecting the zone. The ports 54,62 to the packers are blocked by the poppet sleeves 56 or misaligned release ports 61,62 respectively. The retaining pistons 81,82, are influenced, being in direct contact to the bore 17, and are driven back and forth in the tool annulus 30 under revering pressures. Under collet support sleeve 70 actuating pressures, the retaining pistons 81,82 aid in holding the housing 13 uphole so as to maintain the zone port 35,38 alignment. The design of the tool annulus 30 permits the retaining pistons 81,82 to operate correctly whether the differential pressure is one direction or the other. Bypass port 39 misalignment can be maintained without having to load the mandrel 14 from surface and also to avoid depressurizing the packers 11,12 while causing a suction in the bore 17.

As seen again in FIGS. 11*a* and 11*b*, the retaining pistons 81,82, mandrel 14 and tool annulus 30 have a unique arrangement. In the tool annulus 30 are various shoulders which interfere with free axial movement of the pistons 81,82 and ultimately become uphole and downhole load bearing surfaces. As discussed for the uphole position of the housing 13, the housing 13 has an uphole retaining shoulder 83 and mandrel 14 has a downhole retaining shoulder 84 for stopping the retaining pistons 81,82 respectively as they move apart under positive differential pressures. Further, the mandrel 14 has an uphole retaining shoulder 85 and the housing 13 has a downhole retaining shoulder 86 for stopping the respective retaining pistons 81,82 respectively as they move together under negative differential pressures. Thus, the uphole retaining piston 81 is sandwiched for reciprocating action between the housing's uphole shoulder 83 and the mandrel's uphole shoulder 85. The downhole retaining piston 82 is sandwiched for reciprocating action between the housing's downhole shoulder 86 and the mandrel's downhole shoulder 84. Port 80 is located between the mandrel's uphole shoulder 85 and the housing's downhole shoulder 86.

The assistance granted by the retaining pistons 81,82 is consistent in each position under pressure differential. Returning briefly to the case where the packers 11,12 are set as illustrated in FIGS. 11*a* and 5*a*–5*d*, the retaining pistons 81,82 also aid in maintaining the housing 13 in the intermediate position 17. Similarly, as is the case for zone operations, the pressure in the bore 17 is greater than that in the wellbore annulus 21. Accordingly, the uphole and downhole retaining pistons 81,82 are driven away from the port 80 driving the housing 13 uphole relative to the mandrel 14. Both the uphole and downhole pistons 81,82 aid in maintaining the relative positions of the housing 13 and mandrel 14 and keeping the intermediate ports 35,36,38 misaligned for maintaining pressurization of the packers 11,12.

Tripping Out

Having reference to FIGS. 8*a*–8*d*, when the tool 10 is tripped or run out of the wellbore 20, or merely for resetting the tool 10 for repositioning, one discontinues manipulating the fluid pressure in the bore 17 and pressure in the mandrel and wellbore 20 are permitted to equalize. Accordingly, the retaining pistons 81,82 are no longer driven and impose little or no axial forces on their respective shoulders 83,85 and 86,84 of the mandrel 14 or housing 13. In FIG. 8*a*, the collet's support sleeve 70 is not active under a pressure differential and thus the spring 73 drives the sleeve 70 downhole to engage the collet fingers 42. In the previous uphole position (FIG. 7*a*), and due to the diametric constraint in the tool annulus 30, the sleeve 70 is initially unable to fit into an annular space between the collet fingers 42 and the mandrel 14 and the biasing spring 73 remains somewhat compressed.

The tubing and mandrel 14 are pulled uphole. The packers 11,12 are initially still set, aiding the housing 13 to resist following the uphole movement of the mandrel 14, unrestrained by the restraining pistons 81,82. Eventually, the catches 44 of the collet fingers 42 can again engage the recess 71, resetting the limiting means 40 by allowing the fingers 42 to flex radially outward and enable the support sleeve 70 to again slide in between the fingers 42 and the mandrel 14. The collet 41 is again supported by the sleeve for retaining and maintaining the collet fingers 42 radially extended for resetting the movement limiting action against shoulder 43, locking the collet 40 to the housing 13 once again per FIGS. 3*a*, 4*a* and 8*a*.

Also, as the mandrel 14 moves uphole, the housing 13 again achieves the downhole position. Referring to FIGS. 8*b*,8*d* and again to FIG. 9*c*, it can be seen that the release port 61 is aligned for communication with the packer actuating chamber 51 for releasing the higher packer setting pressure therein back to the lower pressure present in the bore 17. Accordingly the packers 11,12 are released and relax permitting the entire tool 10 to be repositioned or removed from the wellbore 20.

Further, the bypass ports 39 between the mandrel 14 and the housing 13 are realigned to enable the pressure equalization of all the sub-assemblies in the tool as was discussed for the running-in mode and illustrated in FIGS. 3*a*–3*d*.

Manipulation of the relative movement of the housing 13 and mandrel can be through running the tool 10 in or out of the wellbore 20 and setting down or lifting the tubing string and mandrel 14.

With reference to another embodiment such as that shown in FIGS. 2*a*,2*b* and 14*a*,14*b*, drag blocks 90 affixed to the housing 13 can aid in facilitating relative movement between the housing 13 and the mandrel 14. Drag blocks 90 are well known in the industry, only one form of which is illustrated connected at the downhole end 16 of the housing 13. A debris catcher 91 is shown at the downhole end of the mandrel 14.

Further, as shown in FIG. 13, the packer's poppet valve 55 can have optional fluid sealing arrangements. As shown, the poppet valve 55 is beveled and fit with an end seal 59.

Advantages of the novel straddle packer apparatus and method of use include:

- eliminating the prior art manipulation requirements of tubing rotation, or application of weight for setting or holding, and the elimination of balls, plugs;
- use in the more challenging horizontal wells where the use of weight and rotation manipulation are questionable;
- ability for release and re-setting without retrieving;
- equalization of pressures while running which avoids accidental setting;
- packers can be equalized and released through the application of tension;
- automatic resetting when packers are released; and
- fully adjustable spacing to meet any zone isolation range.

The embodiments of the invention for which an exclusive property or privilege is claimed are defined as follows:

1. A method for establishing fluid communication with an isolated zone of a wellbore comprising:

- providing a tool having a mandrel and a housing, the mandrel having a bore and being adapted at an uphole end for connection to a tubing string and being closed at a downhole end, and the housing carrying an uphole packer spaced axially along the housing from a downhole packer, the housing being movable axially on the mandrel;
- positioning the housing on the mandrel at a first position for establishing fluid flow from the wellbore below the downhole packer, through the bore of the mandrel and to the wellbore above the uphole packer for running in the tool;
- positioning the housing on the mandrel position at a second position for blocking fluid flow between the bore of the mandrel and the wellbore above and below the packers and applying a first pressure in the bore of the mandrel to actuate the uphole and downhole packers and isolate the zone therebetween; and
- positioning the housing at a third position for maintaining actuation of the packers, for continuing to block fluid flow between the wellbore above and below the packers and for establishing fluid flow between the bore of the mandrel and the isolated zone.

2. The method of claim 1 further comprising limiting movement between the second and third positions until receipt of a second pressure applied to the bore of the mandrel greater than that of the first pressure.

3. The method of claim 1 further comprising positioning the housing at the first position for releasing the packers and for aligning outer bypass ports in the housing and inner bypass ports in the mandrel for repositioning the tool.

4. The method of claim 3 further comprising aligning an inner release port in the mandrel with a packer port in the housing for establishing fluid communication between each of the uphole and downhole packers and the bore of the mandrel.

5. The method of claim 1 wherein at the first position, the method further comprising aligning outer ports in the housing and inner ports in the mandrel.

6. The method of claim 1 wherein at the second position, the method further comprising misaligning outer ports in the housing and inner ports in the mandrel.

7. The method of claim 1 wherein at the third position, the method further comprising:

misaligning outer bypass ports in the housing and inner bypass ports in the mandrel for continuing to block fluid flow between the wellbore above and below the packers; and aligning outer operation ports in the housing and inner operation ports in the mandrel for establishing fluid flow between the bore of the mandrel and the isolated zone.

8. The method of claim 7 further comprising prior to positioning the housing at third position comprising releasing a movement limitation between the second and third positions.

9. The method of claim 8 wherein the movement limitation is released by applying a second pressure applied to the bore of the mandrel which greater than that of the first pressure.

10. The method of claim 1 further comprising:

at the first position, aligning outer bypass ports in the housing and inner bypass ports in the mandrel;

at the second position, misaligning the outer bypass ports in the housing and the inner bypass ports in the mandrel; and at the third position, misaligning the outer bypass ports in the housing and the inner bypass ports in the mandrel, and aligning outer operation ports in the housing and inner operation ports in the mandrel.

11. The method of claim 10 wherein prior to positioning the housing at a third position, the method further comprising:

applying a second pressure to the bore of the mandrel, the second pressure being greater than that of the first pressure so as to release a movement limitation between the second and third positions.

12. A method for establishing fluid communication with an isolated zone of a wellbore comprising:

providing a tool having a mandrel and a housing, the mandrel having a bore and being adapted at an uphole end for connection to a tubing string and being closed at a downhole end, and the housing carrying an uphole packer spaced axially along the housing from a downhole packer, the housing being movable axially on the mandrel between downhole and uphole positions;

running in the tool, while at least periodically positioning the housing at a downhole position for establishing fluid flow from the wellbore below the downhole packer, through the bore of the mandrel and to the wellbore above the uphole packer while in the downhole position;

positioning the housing at an intermediate position for blocking fluid flow between the bore of the mandrel and the wellbore above and below the packers, the housing being limited to movement between the downhole and intermediate positions by a movement limiting stop;

applying a first pressure in the bore of the mandrel to actuate the uphole and downhole packers;

applying a second higher pressure in the bore of the mandrel for releasing the limiting stop;

positioning the housing at an uphole position for maintaining actuation of the packers, for continuing to block fluid flow between the wellbore above and below the packers and for opening fluid flow between the bore of the mandrel and the zone of the wellbore between the packers.

13. The method of claim 12 further comprising:

positioning the housing at the downhole position for establishing fluid flow from the wellbore below the downhole packer, through the bore of the mandrel and to the wellbore above the uphole packer while in the downhole position; and running out the tool.

14. The method of claim 13 further comprising setting the limiting stop by positioning the housing at the downhole position.

15. A tool for isolating a zone of a wellbore comprising:

a mandrel having a bore and being adapted at an uphole end for connection to a tubing string and being closed at a downhole end;

a housing carrying an uphole packer spaced axially along the housing from a downhole packer, the housing being movable axially on the mandrel between at least three positions;

a first position for aligning cooperating bypass ports in the housing and the mandrel and thereby establishing fluid flow from the wellbore below the downhole packer, through the bore of the mandrel and to the wellbore above the uphole packer for running in the tool;

a second position for misaligning the bypass ports and thereby blocking fluid flow between the bore of the mandrel and the wellbore above and below the packers and aligning packer release ports for establishing fluid communication with the uphole and downhole packers so that application of a first pressure in the bore of the mandrel actuates the uphole and downhole packers and isolates the zone therebetween; and a third position for misaligning the packer release ports for maintaining actuation of the packers misaligning the bypass ports, and aligning an operations port in the housing with an operation port in the mandrel for establishing fluid flow between the bore of the mandrel and the isolated zone.

16. The tool of claim 15 further comprising:

a releasable stop for limiting movement of the housing from the third position until the releasable stop is released by application of a second pressure in the bore of the mandrel which is greater than the first pressure.

17. The tool of claim 16 wherein the releasable stop is reset for again limiting movement of the housing to between the first and second positions by positioning the housing at one of either of the first or second positions.

18. The tool of claim 17 wherein the third position is uphole of the second position and the releasable stop comprised a collet arrangement acting to stop uphole while enabling downhole movement of the housing relative to the mandrel.

19. The tool of claim 18 wherein the collet arrangement comprises:

a plurality of fingers extending uphole from the mandrel and forming a finger annulus therebetween, the fingers having outward facing catches;

a shoulder formed in the housing;

a sleeve biased downhole to engage the finger annulus and maintain the catches in engagement with the shoulder, thereby stopping uphole movement of the housing to the third position; and hydraulic means for driving the sleeve uphole and out of the finger annulus so as to enable the finger to flex radially inwardly and release the catches from the shoulder and enable uphole movement of the housing to the third uphole position.

20. The tool of claim 19 wherein the hydraulic means further comprises:

a stepped diameter along the sleeve for forming a piston and a corresponding stepped diameter along the mandrel;

seals between the mandrel and the sleeve at each diameter; and a port in the mandrel for fluid communication between the bore of the mandrel and the sleeve so that the second pressure in the bore acts on the piston to overcome the bias and retract the sleeve from the finger annulus.

21. The tool of claim 15 wherein each of the uphole and downhole packers comprise:

an annular chamber formed within the housing within which an annular piston operates for actuating a packer element;

an actuating port communicating between the bore of the mandrel and the annular chamber;

a poppet valve in the chamber and operative to open the actuating port when the first pressure in the bore is greater than fluid pressure in the chamber and to normally block the actuating port and retain fluid pressure in the chamber so as to hold the packers in the set position; and a release port in the chamber which is misaligned with a release port in the mandrel in the set position so as to hold the packers in the set position and which is aligned with the release port the mandrel in the released position so as to release fluid pressure from the chamber and thus release the packers.

22. A tool for isolating a zone of a wellbore comprising:

a mandrel having a bore and being adapted at an uphole end for connection to a tubing string and closed at a downhole end;

a housing carrying an uphole packer spaced axially along the housing from a downhole packer, the housing movable axially on the mandrel between a released position and a set position so that in the released position, uphole bypass ports in the mandrel and uphole bypass ports in the housing align and downhole bypass ports in the mandrel and downhole bypass ports in the housing align for fluid communication between the bore of the mandrel and the wellbore above and below the packers; and in the set position, the uphole and downhole bypass ports in the mandrel and the housing are offset for blocking fluid communication between the bore of the mandrel and application of a first pressure in the bore of the mandrel actuates the uphole and downhole packers.

23. The tool of claim 22 further comprising:

intermediate bypass ports in the mandrel and the housing between the uphole and downhole packers which align for fluid communication between the bore of the mandrel and the wellbore in the released position and are misaligned for blocking fluid communication between the bore of the mandrel and the wellbore in the set position.

24. The tool of claim 23 wherein each of the uphole and downhole packers comprise:

an annular chamber formed within the housing within which an annular piston operates for actuating a packer element;

an actuating port communicating between the bore of the mandrel and the annular chamber;

a poppet valve in the chamber and operative to open the actuating port when fluid pressure in the bore is greater than fluid pressure in the chamber and to normally block the actuating port and retain fluid pressure in the chamber so as to hold the packers in the set position; and a release port in the chamber which is misaligned with a release port in the mandrel in the set position so as to hold the packers in the set position and which is aligned with the release port the mandrel in the released position so as to release fluid pressure from the chamber and thus release the packers.

25. The tool of claim 24 further comprising:

seals fit into the annulus between the housing and the mandrel and located either side of the release port into the chamber and wherein the release port in the mandrel is located so as to be sealed remote from the chamber's release port in the set position and sealed in fluid communication with the chamber's release port in the released position.

26. The tool of claim 24 further comprising:

seals fit into an annulus between the housing and the mandrel and located axially either side of the chamber's release port and wherein the mandrel's release port is located in the mandrel so as to be sealably misaligned from the chamber's release port in the set position and sealably aligned in fluid communication with the chamber's release port in the released position.

27. A tool for isolating a zone of a wellbore comprising:

a mandrel having a bore and being adapted at an uphole end for connection to a tubing string;

a housing carrying an uphole packer spaced axially along the housing from a downhole packer, the housing movable axially on the mandrel between an uphole position, an intermediate position and a downhole position, means for flowing fluid between the wellbore below the downhole packer, the bore of the mandrel and the wellbore above the uphole packer while in the downhole position;

means for isolating the bore of the mandrel from the wellbore in the intermediate position so that the packers are actuated when the fluid in the bore of the mandrel is actuated to a first pressure;

means for blocking fluid between the wellbore below the downhole packer and the wellbore above the uphole packer while in the uphole position and establishing fluid communication between the bore and the isolated zone.

* * * * *

UNITED STATES PATENT AND TRADEMARK OFFICE

CERTIFICATE OF CORRECTION

PATENT NO. : 6,782,954 B2 
DATED : August 31, 2004
INVENTOR(S) : Witold P. Serafin, Piro T. Shkurti and Barry J. Tate It is certified that error appears in the above-identified patent and that said Letters Patent is hereby corrected as shown below:

Title page,
Item [30], FOREIGN APPLICATION PRIORITY DATA, add the following:
-- Dec. 14, 2001 (CA) 2,365,218 --

Signed and Sealed this

Fifteenth Day of March, 2005

JON W. DUDAS
*Director of the United States Patent and Trademark Office*